US010446972B2

(12) United States Patent
Ono

(10) Patent No.: US 10,446,972 B2
(45) Date of Patent: Oct. 15, 2019

(54) ELECTRICAL CONNECTOR

(71) Applicant: SMK Corporation, Tokyo (JP)

(72) Inventor: Naoyuki Ono, Chiba (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/105,993

(22) Filed: Aug. 21, 2018

(65) Prior Publication Data

US 2019/0267754 A1 Aug. 29, 2019

(30) Foreign Application Priority Data

Feb. 28, 2018 (JP) ..... 2018-035460

(51) Int. Cl.

| | |
|---|---|
| ***H01R 13/52*** | (2006.01) |
| ***H01R 13/502*** | (2006.01) |
| ***H01R 43/20*** | (2006.01) |
| *H01R 24/60* | (2011.01) |
| *H01R 13/6585* | (2011.01) |

(52) U.S. Cl.

CPC ..... *H01R 13/5216* (2013.01); *H01R 13/5025* (2013.01); *H01R 13/521* (2013.01); *H01R 13/5202* (2013.01); *H01R 43/20* (2013.01); *H01R 13/6585* (2013.01); *H01R 24/60* (2013.01)

(58) Field of Classification Search

CPC ..... H01R 13/5216; H01R 13/5205; H01R 13/5202

USPC ..... 439/607.55

See application file for complete search history.

(56) References Cited

U.S. PATENT DOCUMENTS

| | | | | |
|---|---|---|---|---|
| 6,139,351 | A * | 10/2000 | Schaefer | B60L 3/0069 439/372 |
| 8,385,573 | B2 * | 2/2013 | Higgins | H01R 13/2414 381/322 |
| 9,112,299 | B2 * | 8/2015 | Lu | H01R 13/5227 |
| 9,130,301 | B2 * | 9/2015 | Lu | H01R 13/521 |
| 9,281,608 | B2 * | 3/2016 | Zhao | H01R 13/5202 |
| 9,525,236 | B2 * | 12/2016 | Lee | H01R 13/5202 |
| 9,553,410 | B2 * | 1/2017 | Zhao | H01R 13/6581 |
| 9,960,522 | B2 * | 5/2018 | Tada | H01R 12/707 |
| 10,128,608 | B2 * | 11/2018 | Kasar | H01R 13/521 |
| 10,218,126 | B2 * | 2/2019 | Kurosawa | H01R 24/60 |
| 2012/0315779 | A1 * | 12/2012 | Yudate | H01R 12/724 439/271 |
| 2013/0183845 | A1 * | 7/2013 | Tan | H01R 13/5202 439/271 |

* cited by examiner

*Primary Examiner* — Alexander Gilman

(57) ABSTRACT

An electrical connector can have improved productivity, as well as a reduced size and thickness. The electrical connector includes an insulating housing including a plate-like portion and a main body portion provided at the rear of the plate-like portion so as to protrude laterally relative to the plate-like portion; a conductive contact held by the housing, the contact including connection portions exposed at the plate-like portion so as to be connected to a mating contact of a mating connector and terminal portions protruding from the main body portion; and an elastically deformable seal member provided in the main body portion.

5 Claims, 17 Drawing Sheets

ELECTRICAL CONNECTOR

CROSS REFERENCE TO RELATED APPLICATION

The contents of the following Japanese patent application are incorporated herein by reference, Japanese Patent Application No. 2018-035460 filed on Feb. 28, 2018.

FIELD

The present invention relates to an electrical connector having a watertight function.

BACKGROUND

Conventionally, electrical connectors attached to devices such as electronic devices have been required to have a watertight function in order to make the inside of the devices watertight from the outside. As such an electrical connector, there is known an electrical connector having a structure configured to prevent liquid from getting into the inside of the device through a gap between the connector and the device from outside when attached to the device.

Patent Literature 1 discloses an electrical connector having a watertight function. In the electrical connector, a seal member 6 is provided in the vicinity of an end portion of the casing 2 on a connection terminal insertion side around an outer periphery of the casing 2. In the electrical connector disclosed in Patent Literature 1, the seal member 6 is in press contact with a surface of a case for containing the casing 2 therein on the connection terminal insertion side, in order to prevent water from getting from outside into a gap between the case and the casing 2.

CITATION LIST

Patent Literature

Patent Literature 1: Japanese Patent No. 5155492

SUMMARY

Technical Problem

However, in Patent Literature 1, the casing is required to have a portion to hold the seal member on the connection terminal insertion side, and this hinders downsizing and slimming of the electrical connector. In Patent Literature 1, to prevent upsizing of the electrical connector, the thickness of the seal member has to be reduced. Thus, the case has a reduced press contact capable area in which the seal member has an appropriate compressibility. When the electrical connector is installed in the case, the dimensions of the case are required to be managed with high accuracy, thus causing a reduction in productivity.

An object of the present invention is to provide an electrical connector having improved productivity, as well as a reduced size and thickness.

Solution to Problem

An electrical connector according to an aspect of the present invention includes a holding member including a front protruding portion and a main body portion provided at the rear of the front protruding portion so as to protrude laterally relative to the front protruding portion, the holding member having an insulation property; a contact having a conductive property, the contact being held by the holding member, the contact including a connection portion exposed at the front protruding portion so as to be connected to a mating contact of a mating connector and a terminal portion protruding from the main body portion; and a seal member configured to be elastically deformable and be provided in the main body portion.

When the electrical connector is inserted and installed into an installation member from its rear to its front, the front protruding portion is first inserted into the installation member, and subsequently the main body portion is inserted into the installation member. The seal member is in press contact with the installation member, so that the seal member blocks liquid from getting from outside into the installation member through a gap between the holding member and the installation member.

According to the aspect of the present invention, the electrical connector can have improved productivity, as well as a reduced size and thickness.

DESCRIPTION OF EMBODIMENTS

Figure 1:
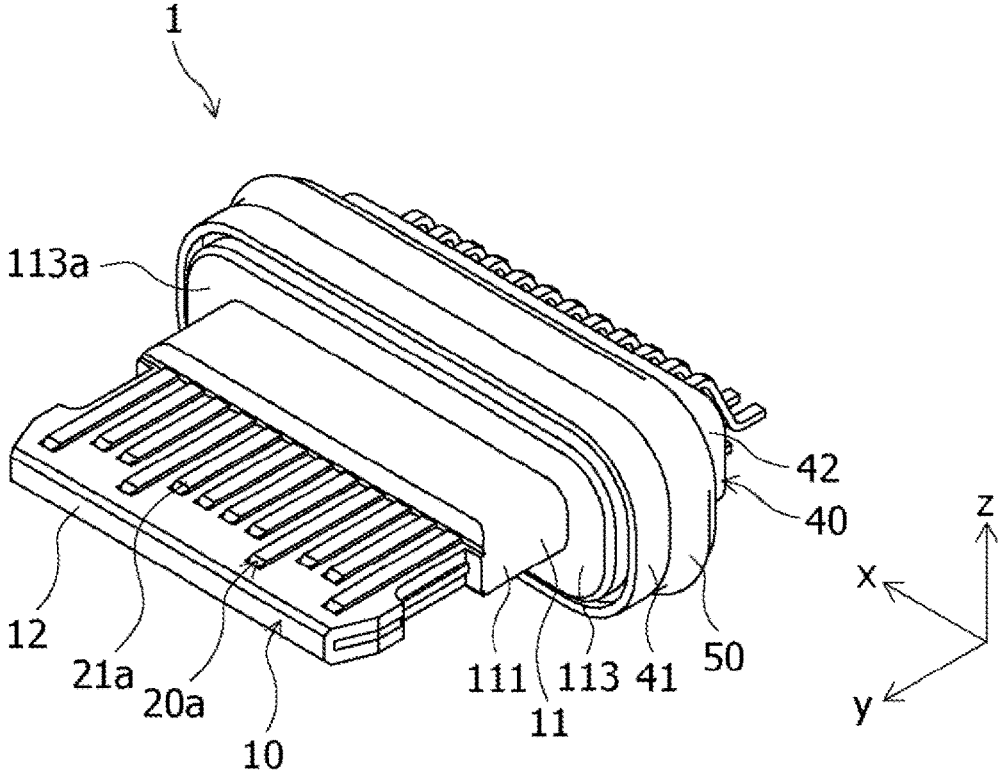
FIG. 1 is a perspective view of an electrical connector, viewed from the diagonally upper front, according to a first embodiment of the present invention.
Figure 2:
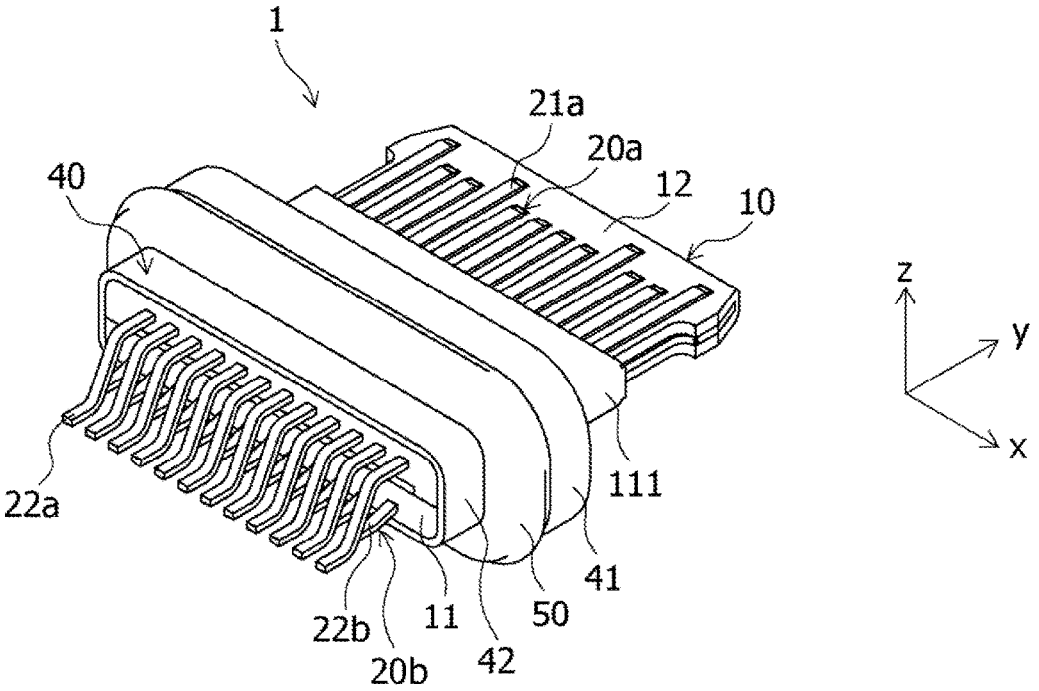
FIG. 2 is a perspective view of the electrical connector, viewed from the diagonally upper rear, according to the first embodiment of the present invention.
Figure 3:
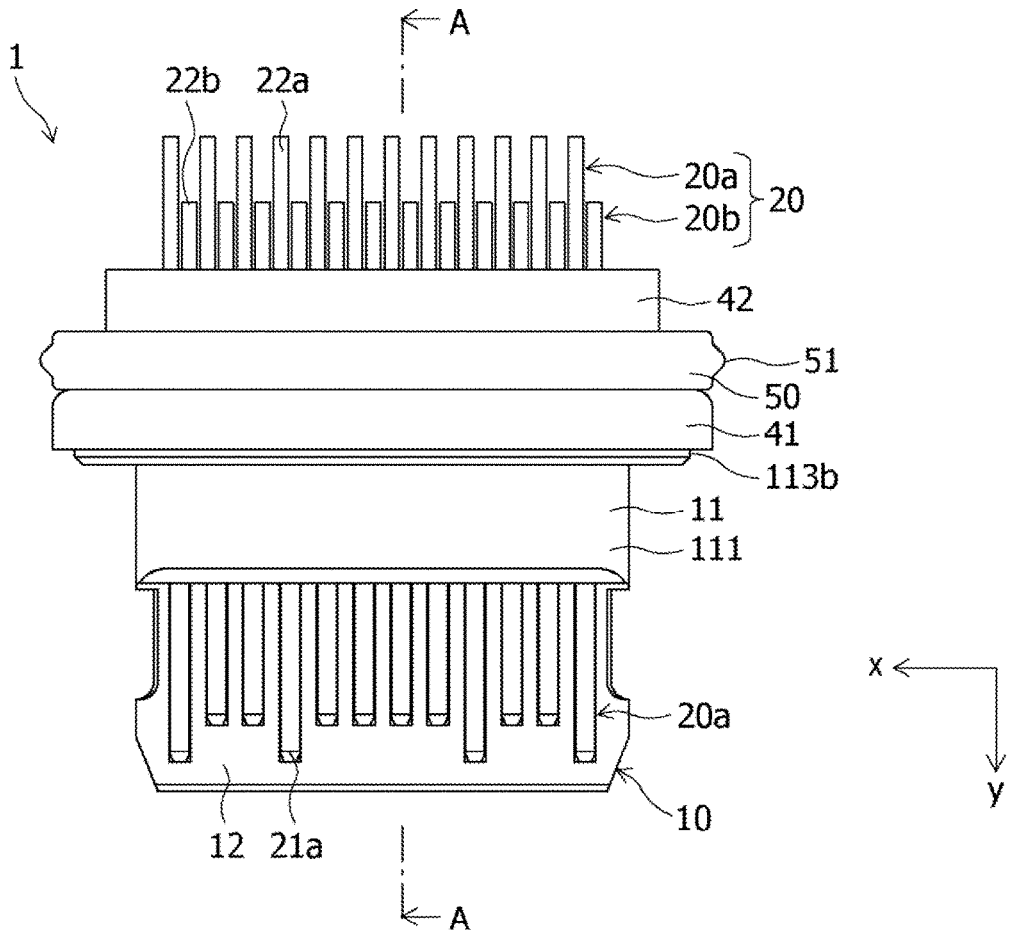
FIG. 3 is a plan view of the electrical connector according to the first embodiment of the present invention.
Figure 4:
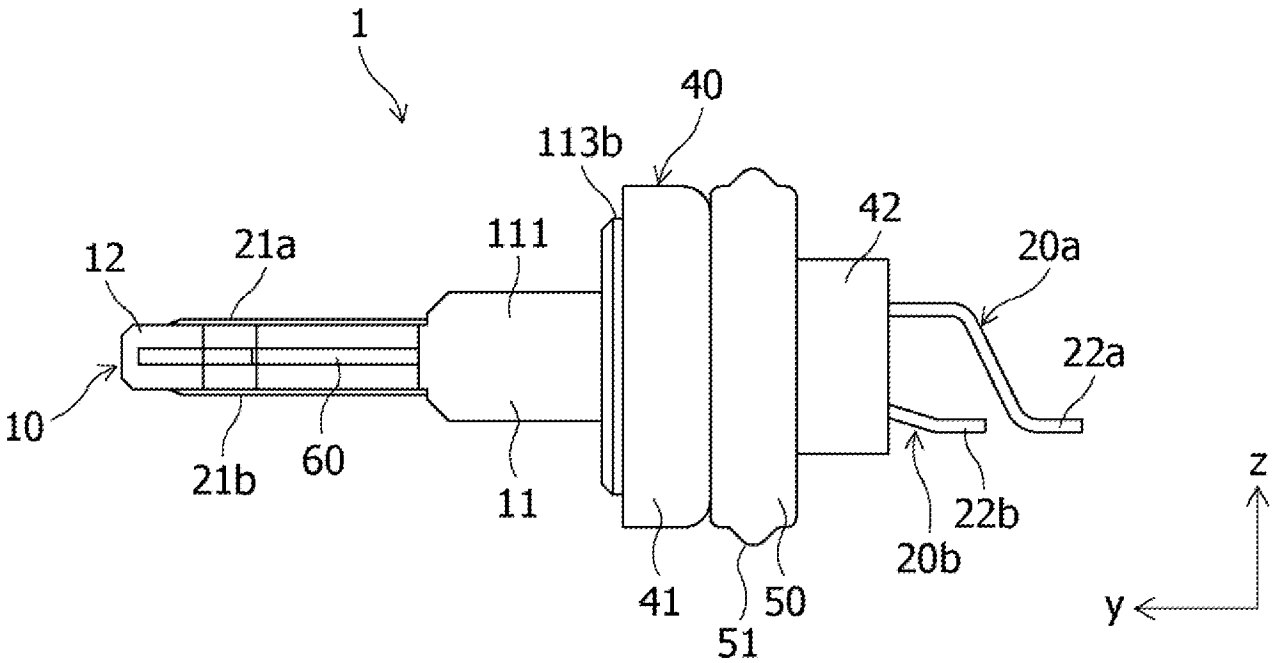
FIG. 4 is a side view of the electrical connector according to the first embodiment of the present invention.

An electrical connector according to embodiment(s) of the present invention will be described below in detail with appropriate reference to the drawings. In the drawings, an x axis, a y axis, and a z axis constitute a three-axis orthogonal coordinate system. In the following description, a positive direction of the y-axis will be referred to as a front direction, a negative direction of the y-axis as a rear direction, the direction of the x-axis as a horizontal direction, a positive direction of the z-axis as an upward direction, and a negative direction of the z-axis as a downward direction.

First Embodiment

<Configuration of Electrical Connector>

A configuration of an electrical connector 1 according to a first embodiment of the present invention will be described below in detail with reference to FIGS. 1 to 8.

The electrical connector 1 according to this embodiment has a housing 10, contacts 20, a shell member 40, a seal member 50, and a shielding plate 60.

The housing 10, which is made of an insulating material, is a holding member for holding the contacts 20. The housing 10 contains a silane coupling agent in a portion that is in close contact with the contacts 20 along outer peripheral surfaces of the contacts 20. Since the silane coupling agent has a reaction group chemically bonding to an inorganic material and a reaction group chemically bonding to an organic material, the silane coupling agent has the property capable of bonding an organic material and an inorganic material.

The housing 10 has a main body portion 11 and a plate-like portion 12.

Figure 5:
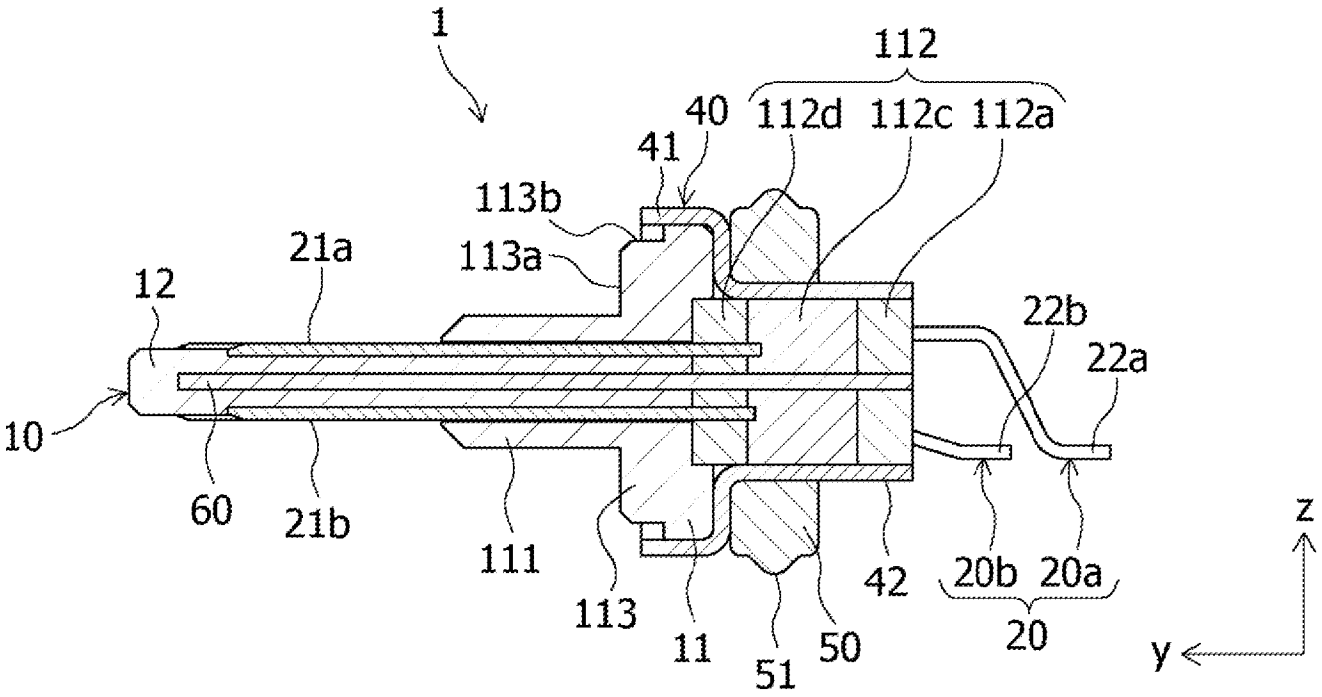
FIG. 5 is a cross-sectional view taken along A-A of FIG. 3.
Figure 6:
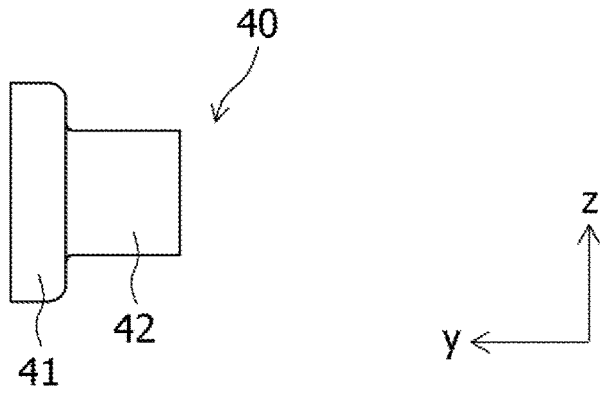
FIG. 6 is a side view of a shell member according to the first embodiment of the present invention.
Figure 7:
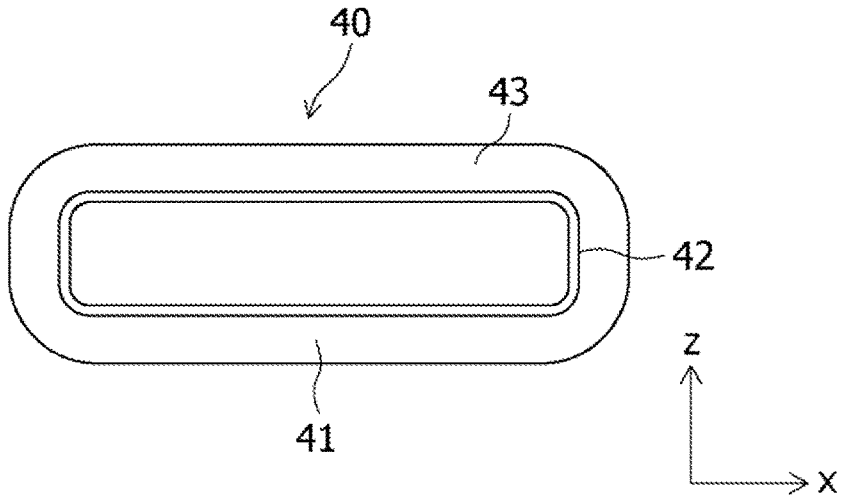
FIG. 7 is a rear view of the shell member according to the first embodiment of the present invention.

The main body portion 11 holds the contacts 20. The main body portion 11 is provided at the rear of the plate-like portion 12 so as to protrude laterally relative to the plate-like portion 12 (in directions orthogonal to front and back directions). As shown in FIG. 5, the main body portion 11 includes a front portion 111, a rear portion 112, and a contact portion 113.

The front portion 111 protrudes forward from a front end of the contact portion 113.

The rear portion 112 is constituted of a front end portion 112*d* that protrudes rearward from a rear end of the contact portion 113 and contains no silane coupling agent, a rear end portion 112*a* that is provided at a rear end of the housing 10 and contains no silane coupling agent, and a watertight resin portion 112*c* that is provided between the front end portion 112*d* and the rear end portion 112*a* and contains a silane coupling agent.

The watertight resin portion 112*c* is in close contact with the shell member 40 along a circumferential direction of an inner peripheral surface of the shell member 40, as well as being in close contact with the contacts 20 along the outer peripheral surfaces of the contacts 20. The watertight resin portion 112*c* is made of a resin of a different type from the resin of the plate-like portion 12, the front portion 111, the rear end portion 112*a*, the front end portion 112*d*, and the contact portion 113. The resin of the watertight resin portion 112*c* melts at a lower temperature than the resin of the plate-like portion 12, the front portion 111, the rear end portion 112*a*, the front end portion 112*d*, and the contact portion 113.

Note that FIG. 5 shows clear boundaries between the front end portion 112*d*, the rear end portion 112*a*, and the watertight resin portion 112*c*, for the sake of explanation, but the boundaries are unclear in fact, because the front end portion 112*d* and the watertight resin portion 112*c* are melted and bonded at their contact portions in a manufacturing process, and the rear end portion 112*a* and the watertight resin portion 112*c* are melted and bonded at their contact portions in the manufacturing process.

The contact portion 113 protrudes laterally between the front portion 111 and the rear portion 112, relative to the front portion 111 and the rear portion 112. A front end of the contact portion 113 is provided with a front end surface 113*a* that is in contact with a not-shown mating connector connected from its front to block a rearward movement of the mating connector, and a contact surface 113*b* that is in contact with an installation member when the electrical connector 1 is installed in the installation member. The contact surface 113*b* is orthogonal to the front end surface 113*a*. The front end surface 113*a* is provided annularly around the front portion 111. The contact surface 113*b* is provided annularly in the outer periphery of the contact portion 113.

The plate-like portion 12, i.e., a front protruding portion, is in the shape of a plate that protrudes forward relative to the main body portion 11.

The contacts 20 are made of a conductive material, and held by the housing 10. The contacts 20 include first contacts 20*a* and second contacts 20*b* disposed below the first contacts 20*a*. The first contacts 20*a* and the second contacts 20*b* are insulated from each other by the housing 10.

Each first contact 20*a* includes a connection portion 21*a* that is exposed on the front side of the housing 10 on a top surface of the plate-like portion 12 to connect to a mating contact of a not-shown mating connector, and a terminal portion 22*a* that protrudes rearward relative to the rear portion 112 of the housing 10 and is soldered to a conductive portion of a not-shown substrate. The first contact 20*a* is embedded in the front portion 111, the rear portion 112, and the contact portion 113 at a portion between the connection portion 21*a* and the terminal portion 22*a*. The first contact 20*a* is in close contact with the watertight resin portion 112*c* along its outer peripheral surface. The first contact 20*a* is bent in the left, right, and upward directions in shape at a portion being in close contact with the watertight resin portion 112*c*.

Each second contact 20*b* includes a connection portion 21*b* that is exposed on the front side of the housing 10 on a bottom surface of the plate-like portion 12 to connect to the mating contact of the not-shown mating connector, and a terminal portion 22*b* that protrudes rearward relative to the rear portion 112 of the housing 10 and is soldered to the not-shown substrate. The second contact 20*b* is embedded in the front portion 111, the rear portion 112, and the contact portion 113 at a portion between the connection portion 21*b* and the terminal portion 22*b*. The second contact 20*b* is in close contact with the watertight resin portion 112*c* along its outer peripheral surface. The second contact 20*b* is bent in the left, right, and downward directions in shape at a portion being in close contact with the watertight resin portion 112*c*. Bottom ends of the terminal portions 22*a* and bottom ends of the terminal portions 22*b* are flush with one another in the vertical direction.

The shell member 40 is made of a conductive material or an insulating material, and is in the shape of a cylinder penetrating in the front and rear directions. The shell member 40 includes a diameter enlarging portion 41 and a constriction portion 42, and thus the shell member 40 is narrowed rearward in shape. The diameter enlarging portion 41, i.e., a lateral protruding portion, protrudes laterally relative to the constriction portion 42. The diameter enlarging portion 41 has a rear end portion 43, with which a front end portion 53 of the seal member 50 is in contact, at its rear end, and is held by the contact portion 113. The constriction portion 42 is continued at the rear of the diameter enlarging portion 41. The constriction portion 42 has a smaller diameter than the diameter enlarging portion 41, and is held by the rear portion 112. The constriction portion 42 is in close contact with the watertight resin portion 112*c* at its inner peripheral surface in a circumferential direction. A front end of the shell member 40 is positioned at the rear of the front end surface 113*a*. The shell member 40 is formed by processing a metal plate (drawing or the like), die casting, or metal injection molding (MIM).

Figure 8:
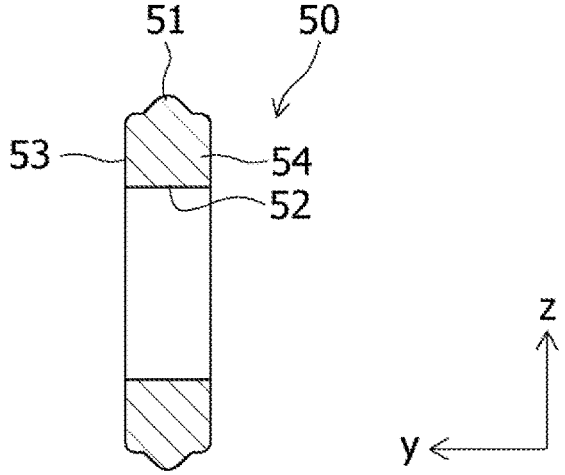
FIG. 8 is a cross-sectional view of a seal member according to the first embodiment of the present invention.

The seal member 50 is in a ring shape, and is provided on an outer periphery of the shell member 40 and also provided to the main body portion 11 via the shell member 40. As shown in FIG. 8, the seal member 50 includes a press contact portion 51 that protrudes laterally relative to the diameter enlarging portion 41 of the shell member 40 so as to be in press contact with an installation member, an internal wall portion 52 that is in contact or press contact with an outer periphery of the constriction portion 42 of the shell member 40, the front end portion 53 that is in contact or press contact with the rear end portion 43 of the diameter enlarging portion 41 of the shell member 40, and a proximal end portion 54 as a secured portion that is secured to the constriction portion 42. The internal wall portion 52 is secured to the outer periphery of the constriction portion 42 by bonding or the like using an adhesive, and the front end portion 53 is secured to the rear end portion 43 by bonding or the like using an adhesive.

The seal member 50 has an insulating property or a conductive property, as well as having elasticity. The seal member 50 having an insulating property is made of an elastic material having an insulating property, such as a thermoplastic elastomer or the like. The seal member 50 having a conductive property is made of an elastic material having an insulating property, such as a thermoplastic elastomer, into which metal particles such as silver particles or conductive powder such as carbon black are dispersed.

Note that the seal member 50 is not necessarily secured to the shell member 40 by bonding, but may be secured to the shell member 40 by press fitting from its rear. The seal member 50 can be secured to the shell member 40 by an arbitrary method. A part of the seal member 50, except for the press contact portion 51 of the seal member 50, may protrude laterally relative to the diameter enlarging portion 41 of the shell member 40.

The shielding plate 60 is made of a conductive material in a plate shape. The shielding plate 60 is embedded in the housing 10. The shielding plate 60 is provided between the first contacts 20*a* and the second contacts 20*b* so as to be insulated from the first contacts 20*a* and the second contacts 20*b*.

<Method for Installing Electrical Connector in Installation Member>

Figure 9:
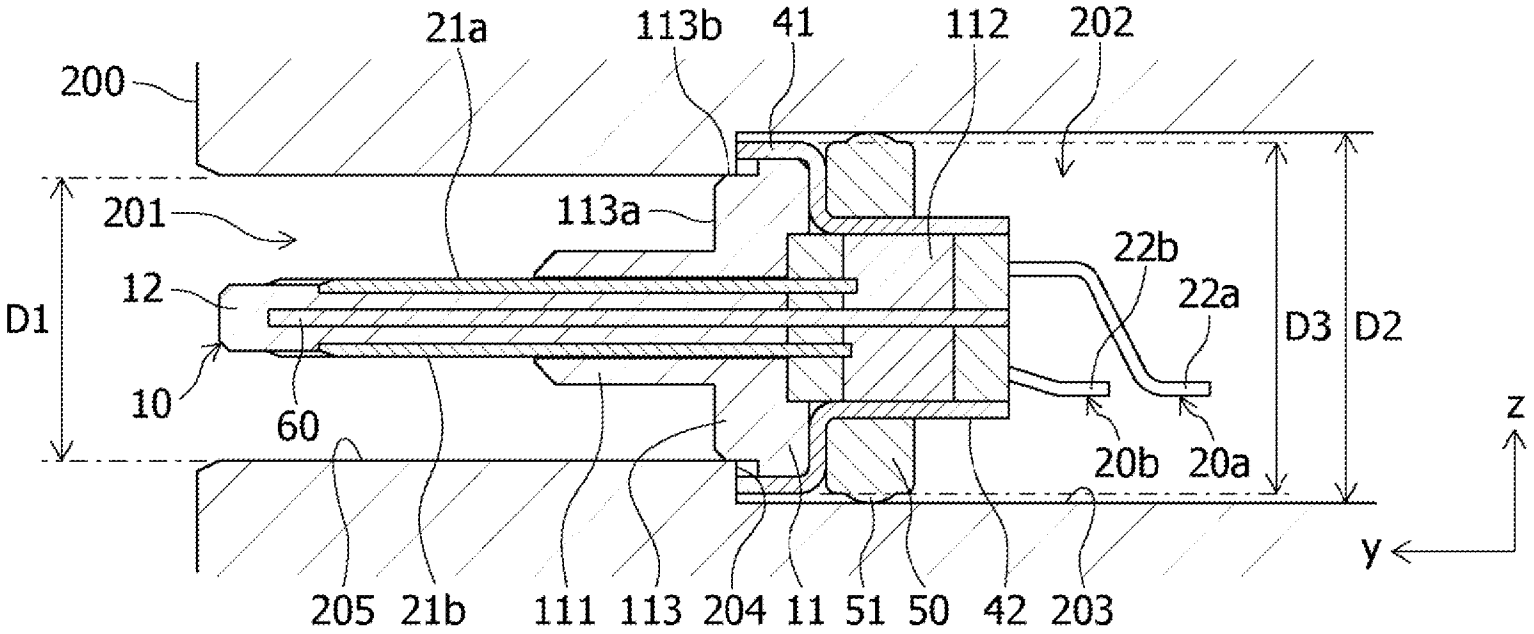
FIG. 9 is a drawing showing a used state of the electrical connector according to the first embodiment of the present invention.

A method for installing the electrical connector 1 according to the first embodiment of the present invention in the installation member will be described below in detail with reference to FIG. 9.

A casing 200, i.e., an installation member of an electronic device in which the electrical connector 1 is installed, has an installation hole 201 whose front end is open outside, and an installation hole 202 that is coupled to the rear of the installation hole 201 and whose rear end is open outside. The inner diameter D2 of the installation hole 202 is larger than the inner diameter D1 of the installation hole 201. By making the inner diameter D2 of the installation hole 202 larger than the inner diameter D1 of the installation hole 201, a contact surface 204 is formed in the casing 200. The casing 200 has an insulating property or a conductive property.

To insert and install the electrical connector 1 into the installation hole 202 from its rear to its front, the plate-like portion 12 and the front portion 111 are inserted into the installation hole 202 from its rear, and subsequently the contact portion 113 and the rear portion 112 are inserted into the installation hole 202 from its rear, and furthermore the shell member 40 is inserted into the installation hole 202 from its rear. The plate-like portion 12 and the front portion 111 are inserted into the installation hole 201 from its rear, and subsequently the contact portion 113 is inserted into the installation hole 201 from its rear. At this time, since the outer diameter of a portion of the contact surface 113*b* of the contact portion 113 is approximately the same as or slightly smaller than the inner diameter D1 of the installation hole 201, the contact surface 113*b* is in contact with an internal wall 205.

Since the seal member 50 is in press contact with an internal wall 203 of the installation hole 202 at the press contact portion 51, the seal member 50 is elastically deformed inwardly. At this time, the proximal end portion 54, i.e., a securing portion of the seal member 50 provided on the constriction portion 42, does not protrude laterally relative to the diameter enlarging portion 41. Therefore, for example, when the electrical connector 1 is shifted or the like in a direction orthogonal to front and back directions, in the middle of inserting the electrical connector 1 into the installation hole 201 and the installation hole 202, the proximal end portion 54 is prevented from getting snagged on the casing 200, and therefore the seal member 50 can be prevented from being damaged or displaced.

Contact of the front end of the diameter enlarging portion 41 with the contact surface 204 of the casing 200 regulates a forward movement of the electrical connector 1, and the electrical connector 1 is thereby completed to be inserted into the installation hole 202. As described above, the contact of the diameter enlarging portion 41 with the contact surface 204 hinders a forward movement of the shell member 40 relative to the casing 200. Therefore, the diameter enlarging portion 41 can be used as a positioning member of the electrical connector 1 relative to the casing 200.

In a state of completing installation of the electrical connector 1 into the installation hole 202, the installation hole 201 of the casing 200 configures an insertion hole into which a mating connector is inserted from its front, and the internal wall 205 of the installation hole 201 and the front end surface 113*a* configure a fitting portion for the mating connector. In the state of completing installation of the electrical connector 1 into the installation hole 202, the contact surface 113*b* is in contact with the internal wall 205, and the entire seal member 50 evenly receives a pressure force from the internal wall 203. Therefore, the plate-like portion 12 is disposed along the internal wall 205 at the center of the installation hole 201, thus allowing a reliable connection between the electrical connector 1 and the mating connector.

When the mating connector is inserted into the fitting portion of the electrical connector 1 from its front, a front end of the mating connector in an insertion direction is in contact with the front end surface 113*a*. The mating connector is thereby hindered from moving rearward, and a connection between the mating connector and the electrical connector 1 is completed. Note that, in a state of completing the connection between the mating connector and the electrical connector 1, a mating contact of the mating connector is electrically connected to the contacts 20 of the electrical connector 1.

Since the seal member 50 is provided in the constriction portion 42 having the smaller diameter than the diameter enlarging portion 41, the inner diameter D2 of the installation hole 202 has approximately the same size as the outside diameter D3 of the diameter enlarging portion 41. When the electrical connector 1 is installed into the installation hole 201 and the installation hole 202, the internal wall 203 can compress the seal member 50 in the distance between the outside diameter D3 of the diameter enlarging portion 41 and the outside diameter of the constriction portion 42, so that the inner diameter D2 of the installation hole 202 can be set without consideration of the limits of compression of the seal member 50. Therefore, the inside diameter D2 of the installation hole 202 can be reduced, thus allowing downsizing and slimming of the casing 200 of the electronic device.

When the electrical connector 1 is installed into the installation hole 201 and the installation hole 202, the internal wall 203 can compress the seal member 50 in the distance between the outside diameter D3 of the diameter enlarging portion 41 and the outside diameter of the constriction portion 42. Accordingly, when a pressure contact force of the seal member 50 against the internal wall 203 is set at a predetermined value, the seal member 50 can be designed in dimensions so as to reduce the compression ratio of the seal member 50, without an increase in the inner diameter D2 of the installation hole 202, as compared with conventional cases, thus allowing downsizing and slimming of the electrical connector 1. A compression load from the internal wall 203 on the seal member 50 can be reduced, thus allowing giving the seal member 50 a longer life.

When the electrical connector 1 is installed into the installation hole 201 and the installation hole 202, the internal wall 203 can compress the seal member 50 in the distance between the outside diameter D3 of the diameter enlarging portion 41 and the outside diameter of the constriction portion 42. Accordingly, since the thickness of a compression portion of the seal member 50 can be increased, a press contact capable area can be enlarged in an appropriate compressibility of the seal member 50 relative to the internal wall 203, and thereby the dimensions of the internal wall 203 are not required to be managed with high accuracy, thus allowing an increase in productivity.

When the casing 200 constituting a part of the fitting portion of the electrical connector 1 has a conductive property, it is possible to reduce noise from outside and thereby improve electrical performance of the electrical connector 1.

When the shell member 40, which is provided on the outer peripheries of the contact portion 113 and the rear portion 112 so as to cover the contact portion 113 and the rear portion 112, has a conductive property, it is possible to reduce noise from outside and thereby improve electrical performance of the electrical connector 1.

Furthermore, when the casing 200 and the shell member 40 have conductive properties, since the front end of the diameter enlarging portion 41 of the shell member 40 is connected to the casing 200, the casing 200 and the shell member 40 cover the outer periphery of the housing 10, so that it is possible to reduce noise from outside and thereby improve electrical performance of the electrical connector 1.

As described above, according to this embodiment, the insulating housing 10 includes the plate-like portion 12 and the main body portion 11 that is provided at the rear of the plate-like portion 12 and protrudes laterally relative to the plate-like portion 12, and the main body portion 11 is provided with the elastically deformable seal member 50. This eliminates the need for providing a portion to hold the seal member 50 on a front end side of the housing 10, thus allowing downsizing and slimming of the electrical connector 1. Since the thickness of the seal member 50 is not reduced more than necessary, a press contact capable area can be enlarged in an appropriate compressibility of the seal member 50 relative to the casing 200, and thereby, when the electrical connector 1 is installed in the casing 200, the dimensions of the casing 200 are not required to be managed with high accuracy, thus allowing an increase in productivity.

According to this embodiment, since the seal member 50 is provided in the main body portion 11 through the shell member 40, the main body portion 11 can be protected. Furthermore, when the shell member 40 has a conductive property, the shell member 40 blocks noise from outside, thus allowing an improvement in electrical performance of the electrical connector 1.

According to this embodiment, the shell member 40 includes the diameter enlarging portion 41 that protrudes laterally in front of the seal member 50. When the electrical connector 1 is installed in the casing 200, the diameter enlarging portion 41 prevents the casing 200 from getting snagged on the proximal end portion 54 of the seal member 50, and therefore the seal member 50 can be prevented from being damaged or displaced relative to the housing 10.

According to this embodiment, since the seal member 50 includes the press contact portion 51 that protrudes laterally relative to the diameter enlarging portion 41 and is in press contact with the installation member, the seal member 50 can be reliably in press contact with the installation member.

According to this embodiment, since the seal member 50 is in contact with the rear end portion 43 of the diameter enlarging portion 41, the seal member 50 can be easily positioned with respect to the shell member 40.

According to this embodiment, since the internal wall 52 of the seal member 50 is secured to the constriction portion 42 by bonding or the like, and the front end portion 53 of the seal member 50 is secured to the rear end portion 43 of the diameter enlarging portion 41 by bonding or the like, the seal member 50 can be secured to the shell member 40 at an increased securing surface. Therefore, since the seal member 50 can be firmly secured to the shell member 40, the seal member 50 is prevented from dropping off.

According to this embodiment, the provision of the seal member 50 on the outer periphery of the shell member 40 eliminates the need for providing a casing to provide the seal member 50, thus allowing downsizing and slimming of the electrical connector 1.

According to this embodiment, in a case where the shell member 40, the seal member 50, and the casing 200 have conductive properties, when the electrical connector 1 is installed in the casing 200, the shell member 40, the seal member 50, and the casing 200 are electrically connected. Therefore, when the casing 200 is a metal casing or the like of the electronic device, the electrical connector 1 can contribute to an improvement in shielding performance of the electronic device or measures against static electricity thereof.

According to this embodiment, since the watertight resin portion 112*c* containing a silane coupling agent is in close contact with the inner peripheral surface of the shell member 40 so as to seal a gap between the watertight resin portion 112*c* and the shell member 40, the interior of the electronic device in which the electrical connector 1 is installed can be tightly sealed from a gap between the housing 10 and the shell member 40, and can be made watertight. In the electrical connector 1, since the watertight resin portion 112*c* containing the silane coupling agent is in close contact with the outer peripheral surfaces of the contacts 20 so as to seal gaps each between the watertight resin portion 112*c* and each contact 20, the interior of the electronic device in which the electrical connector 1 is installed can be tightly sealed from gaps each between the housing 10 and each contact 20 and can be made watertight. Furthermore, since the electrical connector 1 can acquire a watertight function only by providing the watertight resin portion 112*c* between the contacts 20 and the constriction portion 42, the rear side of the electrical connector 1 can be reduced in size.

In this embodiment, the main body portion 11 of the housing 10 may have an arbitrary shape, as long as the main body portion 11 protrudes laterally relative to the plate-like portion 12 and is contained in the shell member 40.

In this embodiment, the shell member may be constituted of only the constriction portion 42 provided in the rear portion 112, without having the diameter enlarging portion 41.

Second Embodiment

<Configuration of Electrical Connector>

The configuration of an electrical connector 2 according to a second embodiment of the present invention will be described below in detail with reference to FIG. 10.

Figure 10:
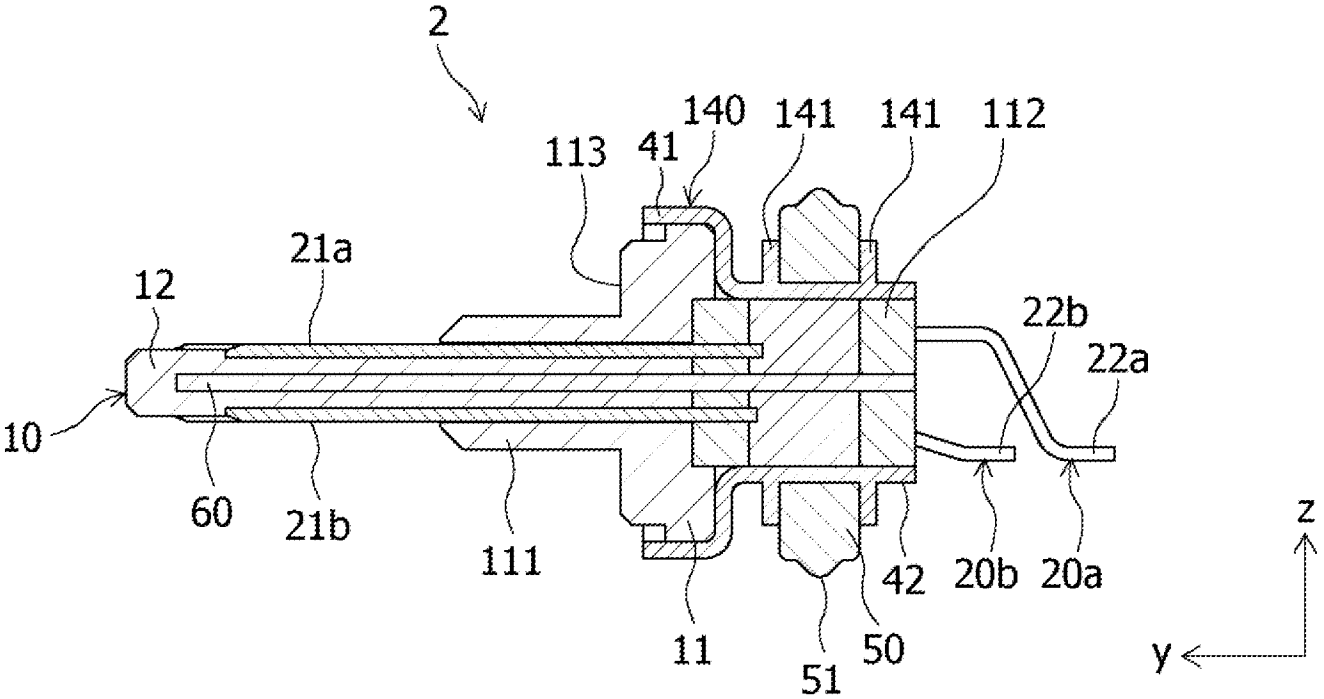
FIG. 10 is a cross-sectional view of an electrical connector according to a second embodiment of the present invention.

Note that, in FIG. 10, the same reference numerals as those in FIGS. 1 to 8 indicate the same components, and a description thereof will be omitted.

The electrical connector 2 according to this embodiment includes a housing 10, contacts 20, a seal member 50, a shielding plate 60, and a shell member 140.

The shell member 140 is made of a conductive material or an insulating material, and is in the shape of a cylinder penetrating in the front and rear directions. A pair of ribs 141 are provided on an outer periphery of a constriction portion 42 of the shell member 140. The ribs 141 protrude laterally less than the diameter enlarging portion 41. A distance between the pair of ribs 141 in the front and rear directions is the same as or slightly larger than the length of the seal member 50 in the front and rear directions in a state of being attached to the shell member 140. Note that the other structure of the shell member 140, except for the above, is the same as that of the shell member 40, so that a description thereof is omitted.

The seal member 50 is attached to the shell member 140 in such a manner as to be contained in the pair of ribs 141.

A method for installing the electrical connector 2 according to this embodiment is the same as the method for installing the electrical connector 1, so that a description thereof is omitted.

As described above, according to this embodiment, the insulating housing 10 includes the plate-like portion 12 and the main body portion 11 that is provided at the rear of the plate-like portion 12 and protrudes laterally relative to the plate-like portion 12, and the main body portion 11 is provided with the elastically deformable seal member 50. This eliminates the need for providing a portion to hold the seal member 50 on a front end side of the housing 10, thus allowing downsizing and slimming of the electrical connector 2. Since the thickness of the seal member 50 is not reduced more than necessary, a press contact capable area can be enlarged in an appropriate compressibility of the seal member 50 relative to the casing 200, and thereby, when the electrical connector 2 is installed in the casing 200, the dimensions of the casing 200 are not required to be managed with high accuracy, thus allowing an increase in productivity.

According to this embodiment, since the seal member 50 is provided in the main body portion 11 through the shell member 140, the main body portion 11 can be protected. Furthermore, when the shell member 140 has a conductive property, the shell member 140 blocks noise from outside, thus allowing an improvement in electrical performance of the electrical connector 1.

According to this embodiment, the shell member 140 includes the diameter enlarging portion 41 that protrudes laterally in front of the seal member 50. When the electrical connector 2 is installed in the casing 200, the casing 200 can be prevented from getting snagged on the proximal end portion 54 of the seal member 50 provided on the housing 10, and therefore the seal member 50 can be prevented from being damaged or displaced relative to the housing 10.

According to this embodiment, since the seal member 50 includes the press contact portion 51 that protrudes laterally relative to the diameter enlarging portion 41 and is in press contact with the installation member, the seal member 50 can be reliably in press contact with the installation member.

According to this embodiment, since the seal member 50 is in contact with the rear end portion 43 of the diameter enlarging portion 41, the seal member 50 can be easily positioned with respect to the shell member 140.

According to this embodiment, since the internal wall 52 of the seal member 50 is secured to the constriction portion 42 by bonding or the like, and the front end portion 53 of the seal member 50 is secured to the rear end portion 43 of the diameter enlarging portion 41 by bonding or the like, the seal member 50 can be secured to the shell member 140 at an increased securing surface. Therefore, since the seal member 50 can be firmly secured to the shell member 140, the seal member 50 is prevented from dropping off.

According to this embodiment, the provision of the seal member 50 on the outer periphery of the shell member 140 eliminates the need for providing a casing to provide the seal member 50, thus allowing downsizing and slimming of the electrical connector 2.

According to this embodiment, since the watertight resin portion 112*c* containing a silane coupling agent is in close contact with the inner peripheral surface of the shell member 140 so as to seal a gap between the watertight resin portion 112*c* and the shell member 140, the interior of the electronic device in which the electrical connector 2 is installed can be tightly sealed from a gap between the housing 10 and the shell member 140, and can be made watertight. In the electrical connector 2, since the watertight resin portion 112*c* containing the silane coupling agent is in close contact with the outer peripheral surfaces of the contacts 20 so as to seal gaps each between the watertight resin portion 112*c* and each contact 20, the interior of the electronic device in which the electrical connector 2 is installed can be tightly sealed from gaps each between the housing 10 and each contact 20 and can be made watertight. Furthermore, since the electrical connector 2 can acquire a watertight function only by providing the watertight resin portion 112*c* between the contacts 20 and the constriction portion 42, the rear side of the electrical connector 2 can be reduced in size.

According to this embodiment, in a case where the seal member 50, the shell member 140, and the casing 200 have conductive properties, when the electrical connector 2 is installed in the casing 200, the shell member 140, the seal member 50, and the casing 200 are electrically connected. Therefore, when the casing 200 is a metal casing or the like of the electronic device, the electrical connector 2 can contribute to an improvement in shielding performance of the electronic device or measures against static electricity thereof.

According to this embodiment, since the seal member 50 is positioned using the ribs 141 provided on the shell member 140, the seal member 50 can be disposed in a desired position with respect to the shell member 140.

The pair of ribs 141 are provided in this embodiment, but a single rib may be provided on the constriction portion 42, and the seal member 50 may be contained between the rib and a rear end portion 43 of a diameter enlarging portion 41.

The ribs 141 are integral with the constriction portion 42 in this embodiment, but a separate member from the shell member 140 may be provided in the shell member 140, and the separate member may have a portion to position the seal member 50.

In this embodiment, the main body portion 11 of the housing 10 may have an arbitrary shape, as long as the main body portion 11 protrudes laterally relative to the plate-like portion 12 and is contained in the shell member 140.

In this embodiment, the shell member may be constituted of only the constriction portion 42 provided in the rear portion 112, without having the diameter enlarging portion 41.

Third Embodiment

The configuration of an electrical connector 3 according to a third embodiment of the present invention will be described below in detail with reference to FIGS. 11 and 12.

Figure 11:
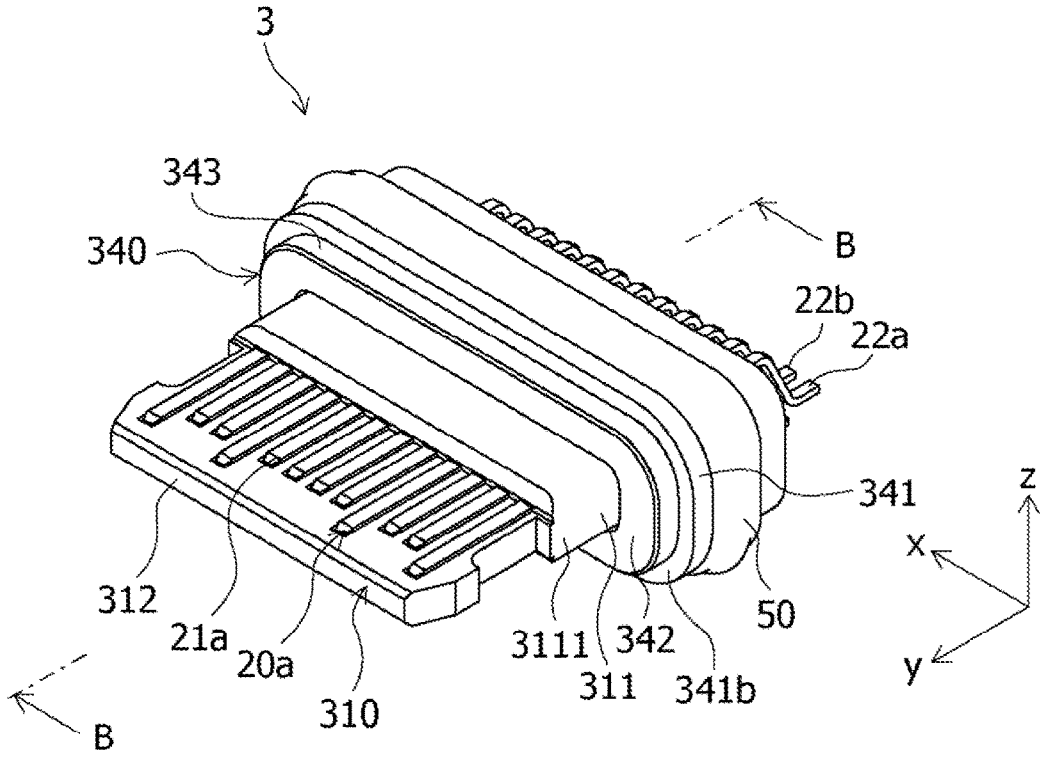
FIG. 11 is a perspective view of an electrical connector according to a third embodiment of the present invention.
Figure 12:
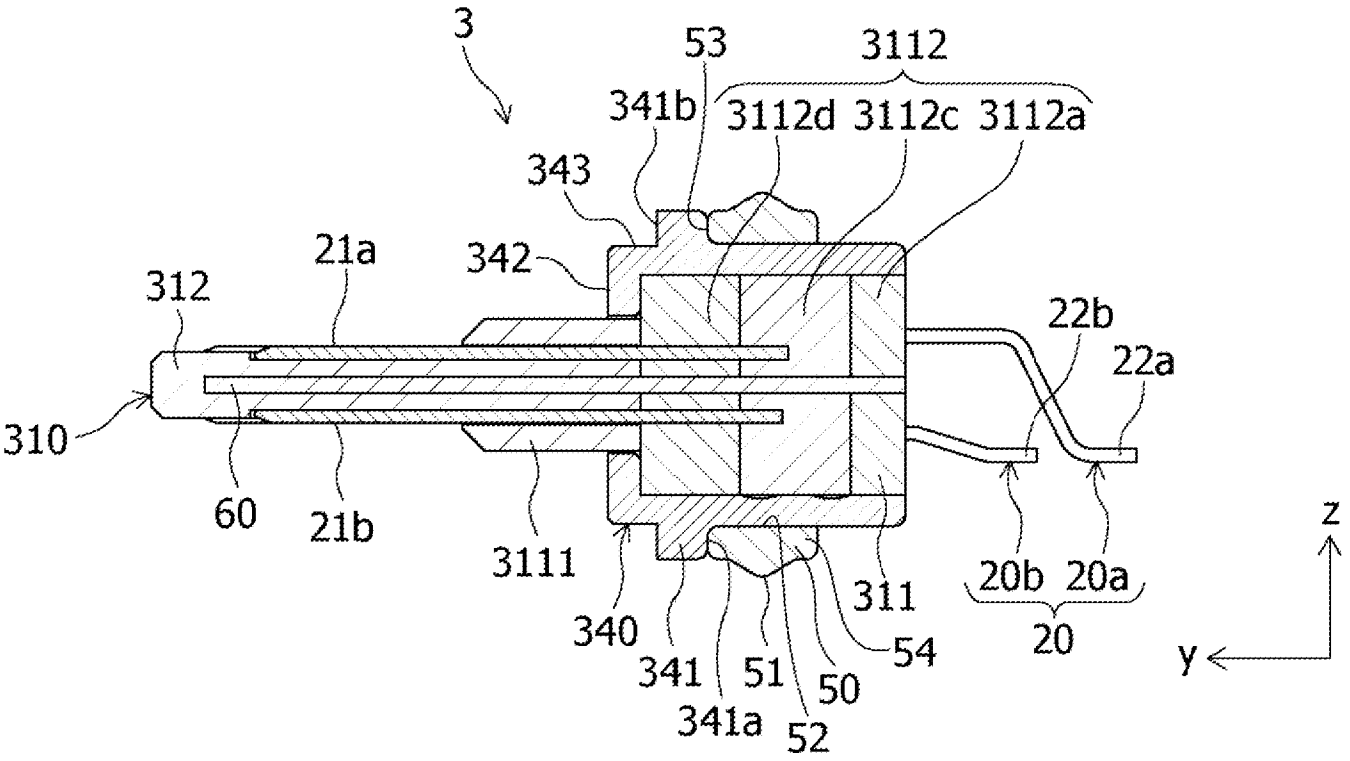
FIG. 12 is a cross-sectional view taken along B-B of FIG. 11.

Note that, in FIGS. 11 and 12, the same reference numerals as those in FIGS. 1 to 8 indicate the same components, and a description thereof will be omitted.

The electrical connector 3 according to this embodiment includes contacts 20, a seal member 50, a shielding plate 60, a housing 310, and a shell member 340.

The housing 310, which is made of an insulating material, is a holding member for holding the contacts 20. The housing 310 contains a silane coupling agent in a portion that is in close contact with the contacts 20 along outer peripheral surfaces of the contacts 20.

The housing 310 has a main body portion 311 and a plate-like portion 312.

The main body portion 311 holds the contacts 20. The main body portion 311 is provided at the rear of the plate-like portion 312 so as to protrude laterally relative to the plate-like portion 312. The main body portion 311 includes a front portion 3111, and a rear portion 3112.

The front portion 3111 protrudes forward from a front end of the rear portion 3112.

The rear portion 3112 is provided at the rear of the front portion 3111 so as to protrude laterally relative to the plate-like portion 312 and the front portion 3111. The rear portion 3112 is constituted of a front end portion 3112*d* containing no silane coupling agent, a rear end portion 3112*a* that is provided at a rear end of the housing 310 and contains no silane coupling agent, and a watertight resin portion 3112*c* that is provided between the front end portion 3112*d* and the rear end portion 3112*a* and contains a silane coupling agent.

The watertight resin portion 3112*c* is in close contact with the shell member 340 along a circumferential direction of an inner peripheral surface of the shell member 340, as well as being in close contact with the contacts 20 along the outer peripheral surfaces of the contacts 20. The watertight resin portion 3112*c* is made of a resin of a different type from the resin of the plate-like portion 312, the front portion 3111, the rear end portion 3112*a*, and the front end portion 3112*d*. The resin of the watertight resin portion 3112*c* melts at a lower temperature than the resin of the plate-like portion 312, the front portion 3111, the rear end portion 3112*a*, and the front end portion 3112*d*.

Note that FIG. 12 shows clear boundaries between the front end portion 3112*d*, the rear end portion 3112*a*, and the watertight resin portion 3112*c*, for the sake of explanation, but the boundaries are unclear in fact, because the front end portion 3112*d* and the watertight resin portion 3112*c* are melted and bonded at their contact portions in a manufacturing process, and the rear end portion 3112*a* and the watertight resin portion 3112*c* are melted and bonded at their contact portions in the manufacturing process.

The plate-like portion 312, i.e., a front protruding portion, is in the shape of a plate that protrudes forward relative to the main body portion 311.

The shell member 340 is made of a conductive material or an insulating material, and is in the shape of a cylinder penetrating in the front and rear directions. The shell member 340 is held by the rear portion 3112, and is in close contact with the watertight resin portion 3112*c* along a circumferential direction of an inner peripheral surface. The shell member 340 is formed by processing a metal plate (drawing or the like), die casting, or metal injection molding.

The shell member 340 includes a rib 341, a contact portion 342, and a contact portion 343.

The rib 341, i.e., a lateral protruding portion, is provided on an outer periphery of the shell member 340 in a circumferential direction, and laterally protrudes at the front of the seal member 50 from the outer periphery of the shell member 340. The rib 341 includes a contact surface 341*a*, with which the front end portion 53 of the seal member 50 is in contact, and a contact surface 341*b* that, when the electrical connector 3 is installed in an installation member, is in contact with the installation member (for example, the contact surface 204 shown in FIG. 9).

The contact portion 342 is formed by bending the front end of the shell member 340 inwardly, and is in contact with a not-shown mating connector connected from its front to prevent a rearward movement of the mating connector.

The contact portion 343 is provided around the front end of the shell member 340 in an annular manner. When the electrical connector 3 is installed in the installation member, the contact portion 343 is in contact with the installation member (for example, the internal wall 205 shown in FIG. 9).

The seal member 50 is in a ring shape, and is provided on an outer periphery of the shell member 340 and also provided to the main body portion 311 via the shell member 340. As shown in FIG. 12, the seal member 50 includes a press contact portion 51 that protrudes laterally relative to the rib 341 of the shell member 340 so as to be in press contact with an installation member, an internal wall portion 52 that is in contact or press contact with an outer periphery of the shell member 340, the front end portion 53 that is in contact or press contact with the contact surface 341*a* of the rib 341 of the shell member 340, and a proximal end portion 54 as a secured portion that is secured to the outer periphery of the shell member 340. The internal wall portion 52 is secured to the outer periphery of the shell member 340 by bonding or the like using an adhesive, and the front end portion 53 is secured to the contact surface 341*a* by bonding or the like using an adhesive.

<Method for Installing Electrical Connector in Installation Member>

A method for installing the electrical connector 3 according to the third embodiment will be described below in detail. By way of example, a method for installing the electrical connector 3 in the casing 200 shown in FIG. 9 will be described.

To insert and install the electrical connector 3 into the installation hole 202 from its rear to its front, the plate-like portion 312 is first inserted into the installation hole 202 from its rear, and subsequently the main body portion 311 is inserted into the installation hole 202 from its rear. The shell member 340 is inserted into the installation hole 202 from its rear, and subsequently the plate-like portion 312 is inserted into the installation hole 201 from its rear. At this time, since the outer diameter of the contact portion 343 of the shell member 340 is approximately the same as or slightly smaller than the inner diameter D1 of the installation hole 201, the contact portion 343 is in contact with the internal wall 205.

Since the seal member 50 is in press contact with the internal wall 203 of the installation hole 202 at the press contact portion 51, the seal member 50 is elastically deformed inwardly. At this time, the proximal end portion 54, i.e., a securing portion of the seal member 50 provided on the shell member 340, does not protrude laterally relative to the rib 341. Therefore, for example, when the electrical connector 3 is shifted or the like in a direction orthogonal to front and back directions in the middle of inserting the electrical connector 3 into the installation hole 201 and the installation hole 202, the proximal end portion 54 is prevented from getting snagged on the casing 200, and therefore the seal member 50 can be prevented from being damaged or displaced.

The electrical connector 3 can be prevented from being upsized, even if the thickness of the seal member 50 is increased. Accordingly, since the thickness of a compression portion of the seal member 50 can be increased without an increase in the inside diameter D2, a press contact capable area can be enlarged in an appropriate compressibility of the seal member 50 against the internal wall 203, and thereby the dimensions of the internal wall 203 are not required to be managed with high accuracy, thus allowing an increase in productivity.

Contact of the contact surface 341*b* of the rib 341 of the shell member 340 with the contact surface 204 of the casing 200 regulates a forward movement of the electrical connector 3, and the electrical connector 3 is thereby completed to be inserted into the casing 200.

As described above, the contact surface 341*b* of the rib 341 of the shell member 340 is in contact with the contact surface 204. Since this hinders a forward movement of the shell member 340 relative to the casing 200, the shell member 340 can be used as a positioning member of the electrical connector 3 relative to the casing 200.

When the casing 200 constituting a part of the fitting portion of the electrical connector 3 has a conductive property, it is possible to reduce noise from outside and thereby improve electrical performance of the electrical connector 3.

When the shell member 340, which is provided on the outer periphery of the rear portion 3112 so as to cover the rear portion 3112, has a conductive property, it is possible to reduce noise from outside and thereby improve electrical performance of the electrical connector 3.

Furthermore, when the casing 200 and the shell member 340 have conductive properties, since the contact portion 343 is connected to the casing 200, the casing 200 and the shell member 340 cover the outer periphery of the housing 310, so that it is possible to reduce noise from outside and thereby improve electrical performance of the electrical connector 3.

In a state of completing installation of the electrical connector 3 in the casing 200, the installation hole 201 of the casing 200 constitutes an insertion hole into which a mating connector is inserted from its front, and the internal wall 205 of the installation hole 201 and the contact portion 342 constitute a fitting portion for the mating connector. In the state of completing installation of the electrical connector 3 in the casing 200, the contact portion 343 is in contact with the internal wall 205, and the entire seal member 50 evenly receives a pressure force from the internal wall 203. Therefore, the plate-like portion 312 is disposed along the internal wall 205 at the center of the installation hole 201, thus allowing a reliable connection between the electrical connector 3 and the mating connector.

When the mating connector is inserted into the foregoing fitting portion of the electrical connector 3 from its front, a front end of the mating connector in an insertion direction is in contact with the contact portion 342. The mating connector is thereby hindered from moving rearward, and a connection between the mating connector and the electrical connector 3 is completed. Note that, in a state of completing a connection between the mating connector and the electrical connector 3, a mating contact of the mating connector is electrically connected to the contact 20 of the electrical connector 3.

As described above, according to this embodiment, the insulating housing 310 includes the plate-like portion 312 and the main body portion 311 that is provided at the rear of the plate-like portion 312 and protrudes laterally relative to the plate-like portion 312, and the main body portion 311 is provided with the elastically deformable seal member 50. This eliminates the need for providing a portion to hold the seal member 50 on a front end side of the housing 310, thus allowing downsizing and slimming of the electrical connector 3. Since the thickness of the seal member 50 is not reduced more than necessary, a press contact capable area can be enlarged in an appropriate compressibility of the seal member 50 relative to the casing 200, and thereby, when the electrical connector 3 is installed in the casing 200, the dimensions of the casing 200 are not required to be managed with high accuracy, thus allowing an increase in productivity.

According to this embodiment, since the seal member 50 is provided in the main body portion 311 through the shell member 340, the main body portion 311 can be protected. Furthermore, when the shell member 340 has a conductive property, the shell member 340 blocks noise from outside, thus allowing an improvement in electrical performance of the electrical connector 3.

According to this embodiment, the shell member 340 includes the rib 341 that protrudes laterally in front of the seal member 50. When the electrical connector 3 is installed in the casing 200, the rib 341 prevents the casing 200 from getting snagged on the proximal end portion 54 of the seal member 50, and therefore the seal member 50 can be prevented from being damaged or displaced relative to the housing 310.

According to this embodiment, since the seal member 50 includes the press contact portion 51 that protrudes laterally relative to the rib 341 and is in press contact with the installation member, the seal member 50 can be reliably in press contact with the installation member.

According to this embodiment, since the seal member 50 is in contact with the contact surface 341*a* of the rib 341, the seal member 50 can be easily positioned with respect to the shell member 340.

According to this embodiment, since the internal wall 52 of the seal member 50 is secured to the outer periphery of the shell member 340 by bonding or the like, and the front end portion 53 of the seal member 50 is secured to the contact surface 341*a* of the rib 341 by bonding or the like, the seal member 50 can be secured to the shell member 340 at an increased securing surface. Therefore, since the seal member 50 can be firmly secured to the shell member 340, the seal member 50 is prevented from dropping off.

According to this embodiment, the provision of the seal member 50 on the outer periphery of the shell member 340 eliminates the need for providing a casing to provide the seal member 50, thus allowing downsizing and slimming of the electrical connector 3.

According to this embodiment, in a case where the seal member 50, the casing 200, and the shell member 340 have conductive properties, when the electrical connector 3 is installed in the casing 200, the shell member 340, the seal member 50, and the casing 200 are electrically connected. Therefore, when the casing 200 is a metal casing or the like of the electronic device, the electrical connector 3 can contribute to an improvement in shielding performance of the electronic device or measures against static electricity thereof.

According to this embodiment, since the watertight resin portion 3112*c* containing a silane coupling agent is in close contact with the inner peripheral surface of the shell member 340 so as to seal a gap between the watertight resin portion 3112*c* and the shell member 340, the interior of the electronic device in which the electrical connector 3 is installed can be tightly sealed from a gap between the housing 310 and the shell member 340, and can be made watertight. In the electrical connector 3, since the watertight resin portion 3112*c* containing the silane coupling agent is in close contact with the outer peripheral surfaces of the contacts 20 so as to seal gaps each between the watertight resin portion 3112*c* and each contact 20, the interior of the electronic device in which the electrical connector 3 is installed can be tightly sealed from gaps each between the housing 310 and each contact 20 and can be made watertight. Furthermore, since the electrical connector 3 can acquire a watertight function only by providing the watertight resin portion 3112*c* between the contacts 20 and the shell member 340, the rear side of the electrical connector 3 can be reduced in size.

In this embodiment, the main body portion 311 of the housing 310 may have an arbitrary shape, as long as the main body portion 311 protrudes laterally relative to the plate-like portion 312 and is contained in the shell member 340.

Fourth Embodiment

The configuration of an electrical connector 4 according to a fourth embodiment of the present invention will be described below in detail with reference to FIGS. 13 and 14.

Figure 13:
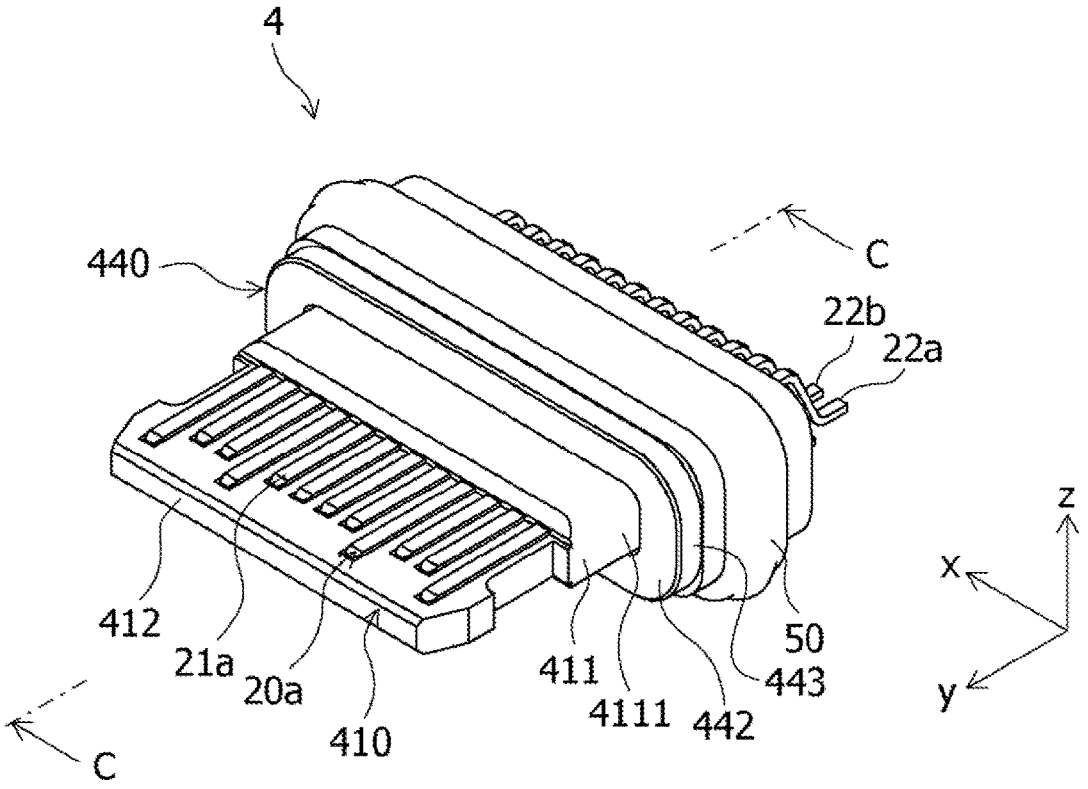
FIG. 13 is a perspective view of an electrical connector according to a fourth embodiment of the present invention.
Figure 14:
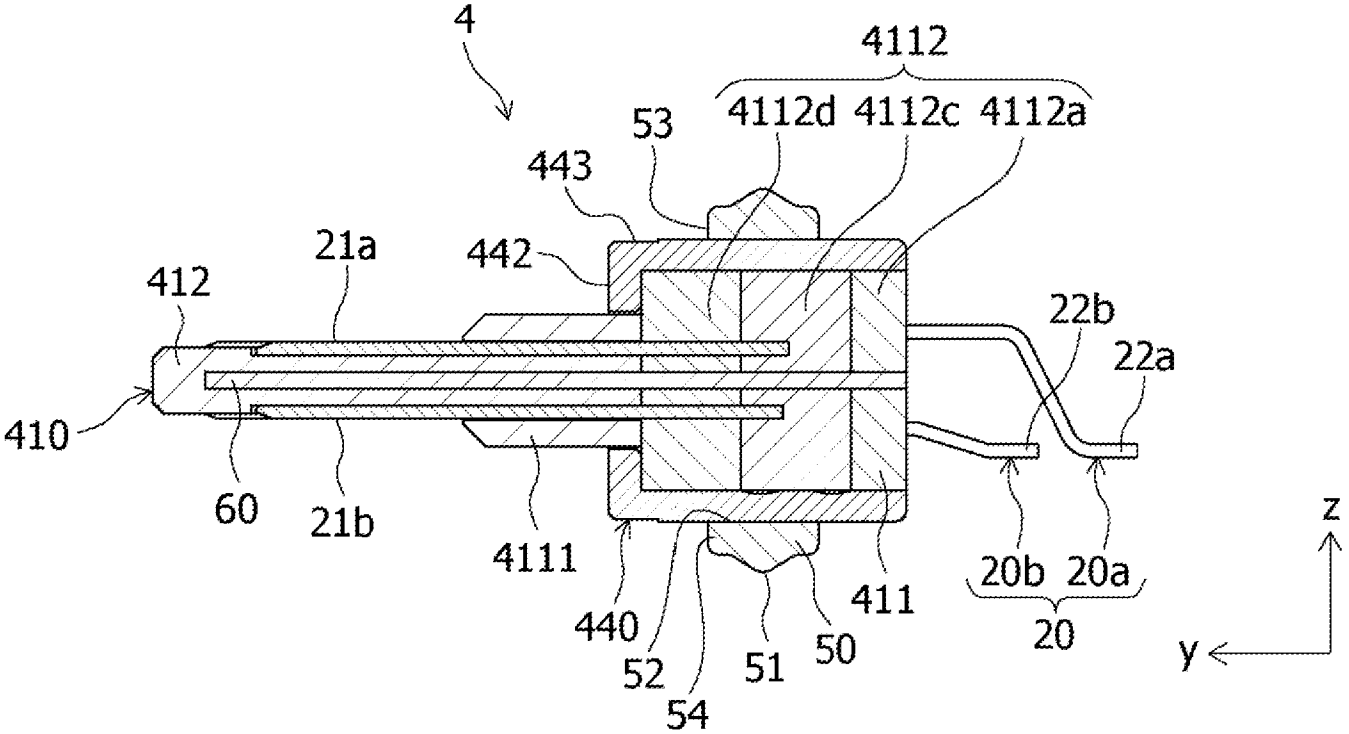
FIG. 14 is a cross-sectional view taken along C-C of FIG. 13.

Note that, in FIGS. 13 and 14, the same reference numerals as those in FIGS. 1 to 8 indicate the same components, and a description thereof will be omitted.

The electrical connector 4 according to this embodiment includes contacts 20, a seal member 50, a shielding plate 60, a housing 410, and a shell member 440.

The housing 410, which is made of an insulating material, is a holding member for holding the contacts 20. The housing 410 contains a silane coupling agent in a portion that is in close contact with the contacts 20 along outer peripheral surfaces of the contacts 20.

The housing 410 has a main body portion 411 and a plate-like portion 412.

The main body portion 411 holds the contacts 20. The main body portion 411 is provided at the rear of the plate-like portion 412 so as to protrude laterally relative to the plate-like portion 412. The main body portion 411 includes a front portion 4111, and a rear portion 4112.

The front portion 4111 protrudes forward from a front end of the rear portion 4112.

The rear portion 4112 is provided at the rear of the front portion 4111 so as to protrude laterally relative to the plate-like portion 412 and the front portion 4111. The rear portion 4112 is constituted of a front end portion 4112*d* containing no silane coupling agent, a rear end portion 4112*a* that is provided at a rear end of the housing 410 and contains no silane coupling agent, and a watertight resin portion 4112*c* that is provided between the front end portion 4112*d* and the rear end portion 4112*a* and contains a silane coupling agent.

The watertight resin portion 4112*c* is in close contact with the shell member 440 along a circumferential direction of an inner peripheral surface of the shell member 440, as well as being in close contact with the contacts 20 along the outer peripheral surfaces of the contacts 20. The watertight resin portion 4112*c* is made of a resin of a different type from the resin of the plate-like portion 412, the front portion 4111, the rear end portion 4112*a*, and the front end portion 4112*d*. The resin of the watertight resin portion 4112*c* melts at a lower temperature than the resin of the plate-like portion 412, the front portion 4111, the rear end portion 4112*a*, and the front end portion 4112*d*.

Note that FIG. 14 shows clear boundaries between the front end portion 4112*d*, the rear end portion 4112*a*, and the watertight resin portion 4112*c*, for the sake of explanation, but the boundaries are unclear in fact, because the front end portion 4112*d* and the watertight resin portion 4112*c* are melted and bonded at their contact portions in a manufacturing process, and the rear end portion 4112*a* and the watertight resin portion 4112*c* are melted and bonded at their contact portions in the manufacturing process.

The plate-like portion 412, i.e., a front protruding portion, is in the shape of a plate that protrudes forward relative to the main body portion 411.

The shell member 440 is made of a conductive material or an insulating material, and is in the shape of a cylinder penetrating in the front and rear directions. The shell member 440 is held by the rear portion 4112, and is in close contact with the watertight resin portion 4112*c* along a circumferential direction of an inner peripheral surface. The shell member 440 is formed by processing a metal plate (drawing or the like), die casting, or metal injection molding.

The shell member 440 includes a contact portion 442, and a contact portion 443.

The contact portion 442 is formed by bending the front end of the shell member 440 inwardly, and is in contact with a not-shown mating connector connected from its front to prevent a rearward movement of the mating connector.

The contact portion 443 is provided around the front end of the shell member 440 in an annular manner. When the electrical connector 4 is installed in the installation member, the contact portion 443 is in contact with the installation member (for example, the internal wall 205 shown in FIG. 9).

The seal member 50 is in a ring shape, and is provided on an outer periphery of the shell member 440 and also provided to the main body portion 411 via the shell member 440. As shown in FIG. 14, the seal member 50 includes a press contact portion 51 that is in press contact with an installation member, an internal wall portion 52 that is in contact or press contact with an outer periphery of the shell member 440, the front end portion 53, and a proximal end portion 54 as a secured portion that is secured to the outer periphery of the shell member 440. The internal wall portion 52 is secured to the outer periphery of the shell member 440 by bonding or the like using an adhesive.

<Method for Installing Electrical Connector in Installation Member>

A method for installing the electrical connector 4 according to the fourth embodiment will be described below in detail. By way of example, a method for installing the electrical connector 4 in the casing 200 shown in FIG. 9 will be described.

To insert and install the electrical connector 4 into the installation hole 202 from its rear to its front, the plate-like portion 412 is first inserted into the installation hole 202 from its rear, and subsequently the main body portion 411 is inserted into the installation hole 202 from its rear. The shell member 440 is inserted into the installation hole 202 from its rear, and subsequently the plate-like portion 412 is inserted into the installation hole 201 from its rear. At this time, since the outer diameter of the contact portion 443 of the shell member 440 is approximately the same as or slightly smaller than the inner diameter D1 of the installation hole 201, the contact portion 443 is in contact with the internal wall 205.

Since the seal member 50 is in press contact with the internal wall 203 of the installation hole 202 at the press contact portion 51, the seal member 50 is elastically deformed inwardly. The electrical connector 4 can be prevented from being upsized, even if the thickness of the seal member 50 is increased. Accordingly, since the thickness of a compression portion of the seal member 50 can be increased without an increase in the inside diameter D2, a press contact capable area can be enlarged in an appropriate compressibility of the seal member 50 against the internal wall 203, and thereby the dimensions of the internal wall 203 are not required to be managed with high accuracy, thus allowing an increase in productivity.

By positioning the electrical connector 4 relative to the casing 200 using not-shown positioning members provided in the electrical connector 4 and the casing 200, the electrical connector 4 is completed to be installed in the casing 200.

When the casing 200 constituting a part of the fitting portion of the electrical connector 4 has a conductive property, it is possible to reduce noise from outside and thereby improve electrical performance of the electrical connector 4.

When the shell member 440, which is provided on the outer periphery of the rear portion 4112 so as to cover the rear portion 4112, has a conductive property, it is possible to reduce noise from outside and thereby improve electrical performance of the electrical connector 4.

Furthermore, when the casing 200 and the shell member 440 have conductive properties, since the contact portion 443 is connected to the casing 200, the casing 200 and the shell member 440 cover the outer periphery of the housing 410, so that it is possible to reduce noise from outside and thereby improve electrical performance of the electrical connector 4.

In a state of completing installation of the electrical connector 4 in the casing 200, the installation hole 201 of the casing 200 constitutes an insertion hole into which a mating connector is inserted from its front, and the internal wall 205 of the installation hole 201 and the contact portion 442 constitute a fitting portion for the mating connector. In the state of completing installation of the electrical connector 4 in the installation hole 201, the contact portion 443 is in contact with the internal wall 205, and the entire seal member 50 evenly receives a pressure force from the internal wall 203. Therefore, the plate-like portion 412 is disposed along the internal wall 205 at the center of the installation hole 201, thus allowing a reliable connection between the electrical connector 4 and the mating connector.

When the mating connector is inserted into the foregoing fitting portion of the electrical connector 4 from its front, a front end of the mating connector in an insertion direction is in contact with the contact portion 442. The mating connector is thereby hindered from moving rearward, and a connection between the mating connector and the electrical connector 4 is completed. Note that, in a state of completing a connection between the mating connector and the electrical connector 4, a mating contact of the mating connector is electrically connected to the contact 20 of the electrical connector 4.

As described above, according to this embodiment, the insulating housing 410 includes the plate-like portion 412 and the main body portion 411 that is provided at the rear of the plate-like portion 412 and protrudes laterally relative to the plate-like portion 412, and the main body portion 411 is provided with the elastically deformable seal member 50. This eliminates the need for providing a portion to hold the seal member 50 on a front end side of the housing 410, thus allowing downsizing and slimming of the electrical connector 4. Since the thickness of the seal member 50 is not reduced more than necessary, a press contact capable area can be enlarged in an appropriate compressibility of the seal member 50 relative to the casing 200, and thereby, when the electrical connector 4 is installed in the casing 200, the dimensions of the casing 200 are not required to be managed with high accuracy, thus allowing an increase in productivity.

According to this embodiment, since the seal member 50 is provided in the main body portion 411 through the shell member 440, the main body portion 411 can be protected. Furthermore, when the shell member 440 has a conductive property, the shell member 440 blocks noise from outside, thus allowing an improvement in electrical performance of the electrical connector 4.

According to this embodiment, since the seal member 50 includes the press contact portion 51 that protrudes laterally and is in press contact with the installation member, the seal member 50 can be reliably in press contact with the installation member.

According to this embodiment, the provision of the seal member 50 on the outer periphery of the shell member 440 eliminates the need for providing a casing to provide the seal member 50, thus allowing downsizing and slimming of the electrical connector 4.

According to this embodiment, in a case where the seal member 50, the casing 200, and the shell member 440 have conductive properties, when the electrical connector 4 is installed in the casing 200, the shell member 440, the seal member 50, and the casing 200 are electrically connected. Therefore, when the casing 200 is a metal casing or the like of the electronic device, the electrical connector 4 can contribute to an improvement in shielding performance of the electronic device or measures against static electricity thereof.

According to this embodiment, since the watertight resin portion 4112*c* containing a silane coupling agent is in close contact with the inner peripheral surface of the shell member 440 so as to seal a gap between the watertight resin portion 4112*c* and the shell member 440, the interior of the electronic device in which the electrical connector 4 is installed can be tightly sealed from a gap between the housing 410 and the shell member 440, and can be made watertight. In the electrical connector 4, since the watertight resin portion 4112*c* containing the silane coupling agent is in close contact with the outer peripheral surfaces of the contacts 20 so as to seal gaps each between the watertight resin portion 4112*c* and each contact 20, the interior of the electronic device in which the electrical connector 4 is installed can be tightly sealed from gaps each between the housing 410 and each contact 20 and can be made watertight. Furthermore, since the electrical connector 4 can acquire a watertight function only by providing the watertight resin portion 4112*c* between the contacts 20 and the shell member 440, the rear side of the electrical connector 4 can be reduced in size.

According to this embodiment, since the shell member 440 is in the shape of a cylinder having a less number of projections and depressions, the shell member 440 can be easily formed.

In this embodiment, the main body portion 411 of the housing 410 may have an arbitrary shape, as long as the main body portion 411 protrudes laterally relative to the plate-like portion 412 and is contained in the shell member 440.

Fifth Embodiment

The configuration of an electrical connector 5 according to a fifth embodiment of the present invention will be described below in detail with reference to FIGS. 15 and 16.

Figure 15:
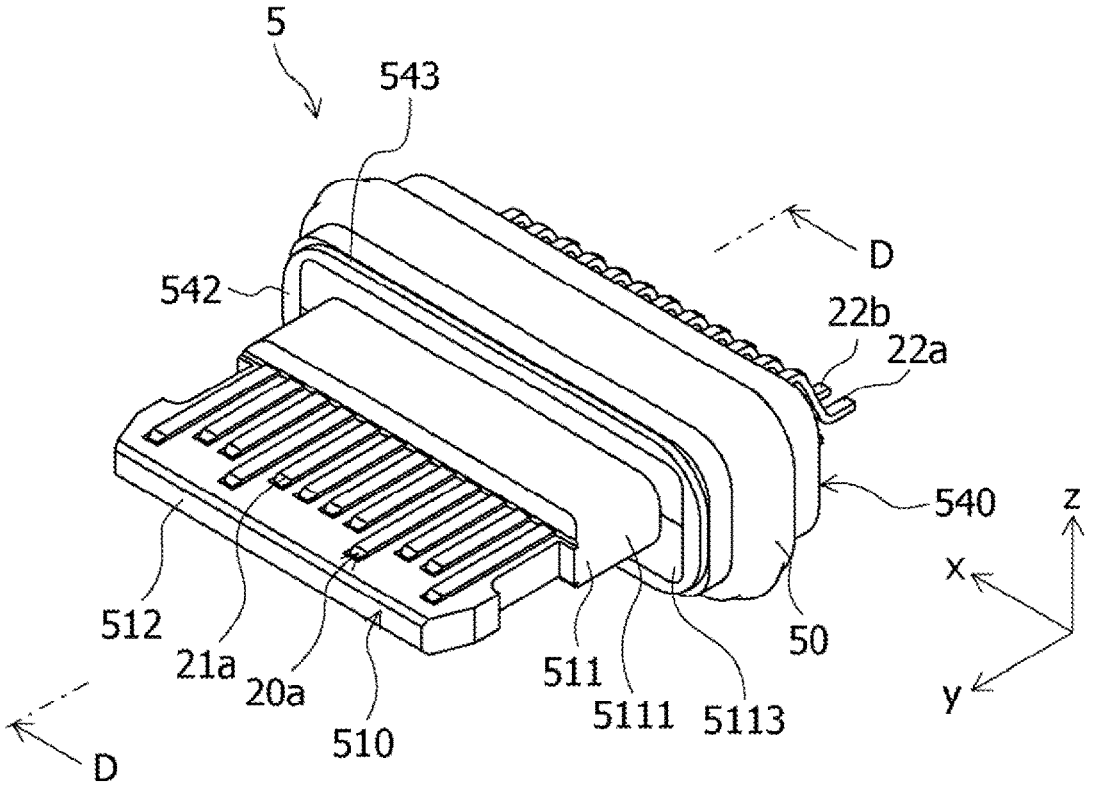
FIG. 15 is a perspective view of an electrical connector according to a fifth embodiment of the present invention.
Figure 16:
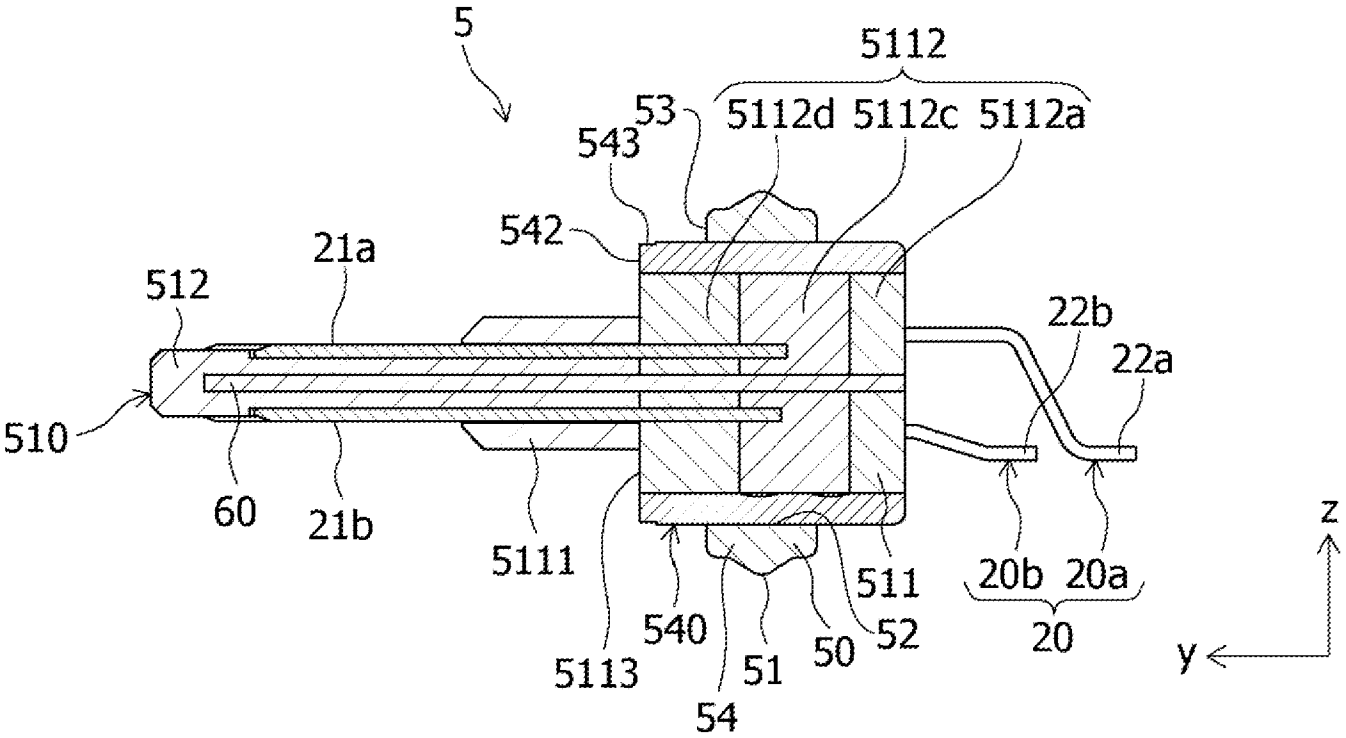
FIG. 16 is a cross-sectional view taken along D-D of FIG. 15.

Note that, in FIGS. 15 and 16, the same reference numerals as those in FIGS. 1 to 8 indicate the same components, and a description thereof will be omitted.

The electrical connector 5 according to this embodiment includes contacts 20, a seal member 50, a shielding plate 60, a housing 510, and a shell member 540.

The housing 510, which is made of an insulating material, is a holding member for holding the contacts 20. The housing 510 contains a silane coupling agent in a portion that is in close contact with the contacts 20 along outer peripheral surfaces of the contacts 20.

The housing 510 has a main body portion 511 and a plate-like portion 512.

The main body portion 511 holds the contacts 20. The main body portion 511 is provided at the rear of the plate-like portion 512 so as to protrude laterally relative to the plate-like portion 512. The main body portion 511 includes a front portion 5111, and a rear portion 5112.

The front portion 5111 protrudes forward from a front end of the rear portion 5112.

The rear portion 5112 is provided at the rear of the front portion 5111 so as to protrude laterally relative to the plate-like portion 512 and the front portion 5111. The rear portion 5112 is constituted of a front end portion 5112*d* containing no silane coupling agent, a rear end portion 5112*a* that is provided at a rear end of the housing 510 and contains no silane coupling agent, and a watertight resin portion 5112*c* that is provided between the front end portion 5112*d* and the rear end portion 5112*a* and contains a silane coupling agent.

The watertight resin portion 5112*c* is in close contact with the shell member 540 along a circumferential direction of an inner peripheral surface of the shell member 540, as well as being in close contact with the contacts 20 along the outer peripheral surfaces of the contacts 20. The watertight resin portion 5112*c* is made of a resin of a different type from the resin of the plate-like portion 512, the front portion 5111, the rear end portion 5112*a*, and the front end portion 5112*d*. The resin of the watertight resin portion 5112*c* melts at a lower temperature than the resin of the plate-like portion 512, the front portion 5111, the rear end portion 5112*a*, and the front end portion 5112*d*.

The front end portion 5112*d* includes a contact portion 5113 that is in contact with a not-shown mating connector connected from its front to prevent a rearward movement of the mating connector.

Note that FIG. 16 shows clear boundaries between the front end portion 5112*d*, the rear end portion 5112*a*, and the watertight resin portion 5112*c*, for the sake of explanation, but the boundaries are unclear in fact, because the front end portion 5112*d* and the watertight resin portion 5112*c* are melted and bonded at their contact portions in a manufacturing process, and the rear end portion 5112*a* and the watertight resin portion 5112*c* are melted and bonded at their contact portions in the manufacturing process.

The plate-like portion 512, i.e., a front protruding portion, is in the shape of a plate that protrudes forward relative to the main body portion 511.

The shell member 540 is made of a conductive material or an insulating material, and is in the shape of a cylinder penetrating in the front and rear directions. The shell member 540 is held by the rear portion 5112, and is in close contact with the watertight resin portion 5112*c* along a circumferential direction of an inner peripheral surface. The shell member 540 is formed by processing a metal plate (drawing or the like), die casting, or metal injection molding.

The shell member 540 includes a contact portion 542, and a contact portion 543.

The contact portion 542 is in contact with a not-shown mating connector connected from its front to prevent a rearward movement of the mating connector.

The contact portion 543 is provided around the front end of the shell member 540 in an annular manner. When the electrical connector 5 is installed in the installation member, the contact portion 543 is in contact with the installation member (for example, the internal wall 205 shown in FIG. 9).

The seal member 50 is in a ring shape, and is provided on an outer periphery of the shell member 540 and also provided to the main body portion 511 via the shell member 540. As shown in FIG. 16, the seal member 50 includes a press contact portion 51 that is in press contact with an installation member, an internal wall portion 52 that is in contact or press contact with an outer periphery of the shell member 540, the front end portion 53 that is in contact or press contact with the installation member, and a proximal end portion 54 as a secured portion that is secured to the outer periphery of the shell member 540. The internal wall portion 52 is secured to the outer periphery of the shell member 540 by bonding or the like using an adhesive.

<Method for Installing Electrical Connector in Installation Member>

A method for installing the electrical connector 5 according to the fifth embodiment will be described below in detail. By way of example, a method for installing the electrical connector 5 in the casing 200 shown in FIG. 9 will be described.

To insert and install the electrical connector 5 into the installation hole 202 from its rear to its front, the plate-like portion 512 is first inserted into the installation hole 202 from its rear, and subsequently the main body portion 511 is inserted into the installation hole 202 from its rear. The shell member 540 is inserted into the installation hole 202 from its rear, and subsequently the plate-like portion 512 is inserted into the installation hole 201 from its rear. At this time, since the outer diameter of the contact portion 543 of the shell member 540 is approximately the same as or slightly smaller than the inner diameter D1 of the installation hole 201, the contact portion 543 is in contact with the internal wall 205.

Since the seal member 50 is in press contact with the internal wall 203 of the installation hole 202 at the press contact portion 51, the seal member 50 is elastically deformed inwardly. The electrical connector 5 can be prevented from being upsized, even if the thickness of the seal member 50 is increased. Accordingly, since the thickness of a compression portion of the seal member 50 can be increased without an increase in the inside diameter D2, a press contact capable area can be enlarged in an appropriate compressibility of the seal member 50 against the internal wall 203, and thereby the dimensions of the internal wall 203 are not required to be managed with high accuracy, thus allowing an increase in productivity.

By positioning the electrical connector 5 relative to the casing 200 using not-shown positioning members provided in the electrical connector 5 and the casing 200, the electrical connector 5 is completed to be installed in the casing 200.

When the casing 200 constituting a part of the fitting portion of the electrical connector 5 has a conductive property, it is possible to reduce noise from outside and thereby improve electrical performance of the electrical connector 5.

When the shell member 540, which is provided on the outer periphery of the rear portion 5112 so as to cover the rear portion 5112, has a conductive property, it is possible to reduce noise from outside and thereby improve electrical performance of the electrical connector 5.

Furthermore, when the casing 200 and the shell member 540 have conductive properties, since the contact portion 543 is connected to the casing 200, the casing 200 and the shell member 540 cover the outer periphery of the housing 510, so that it is possible to reduce noise from outside and thereby improve electrical performance of the electrical connector 5.

In a state of completing installation of the electrical connector 5 in the casing 200, the installation hole 201 of the casing 200 constitutes an insertion hole into which a mating connector is inserted from its front, and the internal wall 205 of the installation hole 201 and the contact portion 542 and the contact portion 5113 constitute a fitting portion for the mating connector. In the state of completing installation of the electrical connector 5 in the installation hole 201, the contact portion 543 is in contact with the internal wall 205, and the entire seal member 50 evenly receives a pressure force from the internal wall 203. Therefore, the plate-like portion 512 is disposed along the internal wall 205 at the center of the installation hole 201, thus allowing a reliable connection between the electrical connector 5 and the mating connector.

When the mating connector is inserted into the foregoing fitting portion of the electrical connector 5 from its front, a front end of the mating connector in an insertion direction is in contact with the contact portion 542 and the contact portion 5113. The mating connector is thereby hindered from moving rearward, and a connection between the mating connector and the electrical connector 5 is completed. Note that, in a state of completing a connection between the mating connector and the electrical connector 5, a mating contact of the mating connector is electrically connected to the contact 20 of the electrical connector 5.

As described above, according to this embodiment, the insulating housing 510 includes the plate-like portion 512 and the main body portion 511 that is provided at the rear of the plate-like portion 512 and protrudes laterally relative to the plate-like portion 512, and the main body portion 511 is provided with the elastically deformable seal member 50. This eliminates the need for providing a portion to hold the seal member 50 on a front end side of the housing 510, thus allowing downsizing and slimming of the electrical connector 5. Since the thickness of the seal member 50 is not reduced more than necessary, a press contact capable area can be enlarged in an appropriate compressibility of the seal member 50 relative to the casing 200, and thereby, when the electrical connector 5 is installed in the casing 200, the dimensions of the casing 200 are not required to be managed with high accuracy, thus allowing an increase in productivity.

According to this embodiment, since the seal member 50 is provided in the main body portion 511 through the shell member 540, the main body portion 511 can be protected. Furthermore, when the shell member 540 has a conductive property, the shell member 540 blocks noise from outside, thus allowing an improvement in electrical performance of the electrical connector 5.

According to this embodiment, since the seal member 50 includes the press contact portion 51 that protrudes laterally and is in press contact with the installation member, the seal member 50 can be reliably in press contact with the installation member.

According to this embodiment, the provision of the seal member 50 on the outer periphery of the shell member 540 eliminates the need for providing a casing to provide the seal member 50, thus allowing downsizing and slimming of the electrical connector 5.

According to this embodiment, in a case where the seal member 50, the casing 200, and the shell member 540 have conductive properties, when the electrical connector 5 is installed in the casing 200, the shell member 540, the seal member 50, and the casing 200 are electrically connected. Therefore, when the casing 200 is a metal casing or the like of the electronic device, the electrical connector 5 can contribute to an improvement in shielding performance of the electronic device or measures against static electricity thereof.

According to this embodiment, since the watertight resin portion 5112*c* containing a silane coupling agent is in close contact with the inner peripheral surface of the shell member 540 so as to seal a gap between the watertight resin portion 5112*c* and the shell member 540, the interior of the electronic device in which the electrical connector 5 is installed can be tightly sealed from a gap between the housing 510 and the shell member 540, and can be made watertight. In the electrical connector 5, since the watertight resin portion 5112*c* containing the silane coupling agent is in close contact with the outer peripheral surfaces of the contacts 20 so as to seal gaps each between the watertight resin portion 5112*c* and each contact 20, the interior of the electronic device in which the electrical connector 5 is installed can be tightly sealed from gaps between the housing 510 and the contacts 20 and can be made watertight. Furthermore, since the electrical connector 5 can acquire a watertight function only by providing the watertight resin portion 5112*c* between the contacts 20 and the shell member 540, the rear side of the electrical connector 5 can be reduced in size.

According to this embodiment, since the shell member 540 is in the shape of a cylinder having a less number of projections and depressions, the shell member 540 can be easily formed.

In this embodiment, the main body portion 511 of the housing 510 may have an arbitrary shape, as long as the main body portion 511 protrudes laterally relative to the plate-like portion 512 and is contained in the shell member 540.

Sixth Embodiment

The structure of an electrical connector 6 according to a sixth embodiment of the present invention will be described below in detail with reference to FIGS. 17 and 18.

Figure 17:
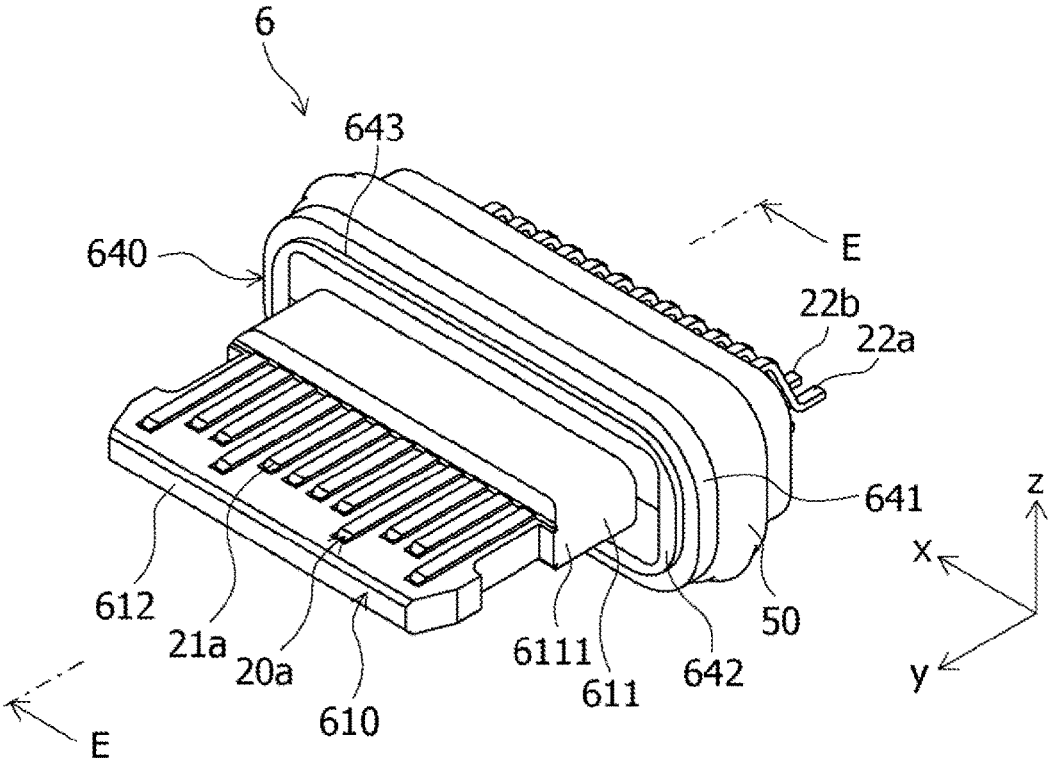
FIG. 17 is a perspective view of an electrical connector according to a sixth embodiment of the present invention.
Figure 18:
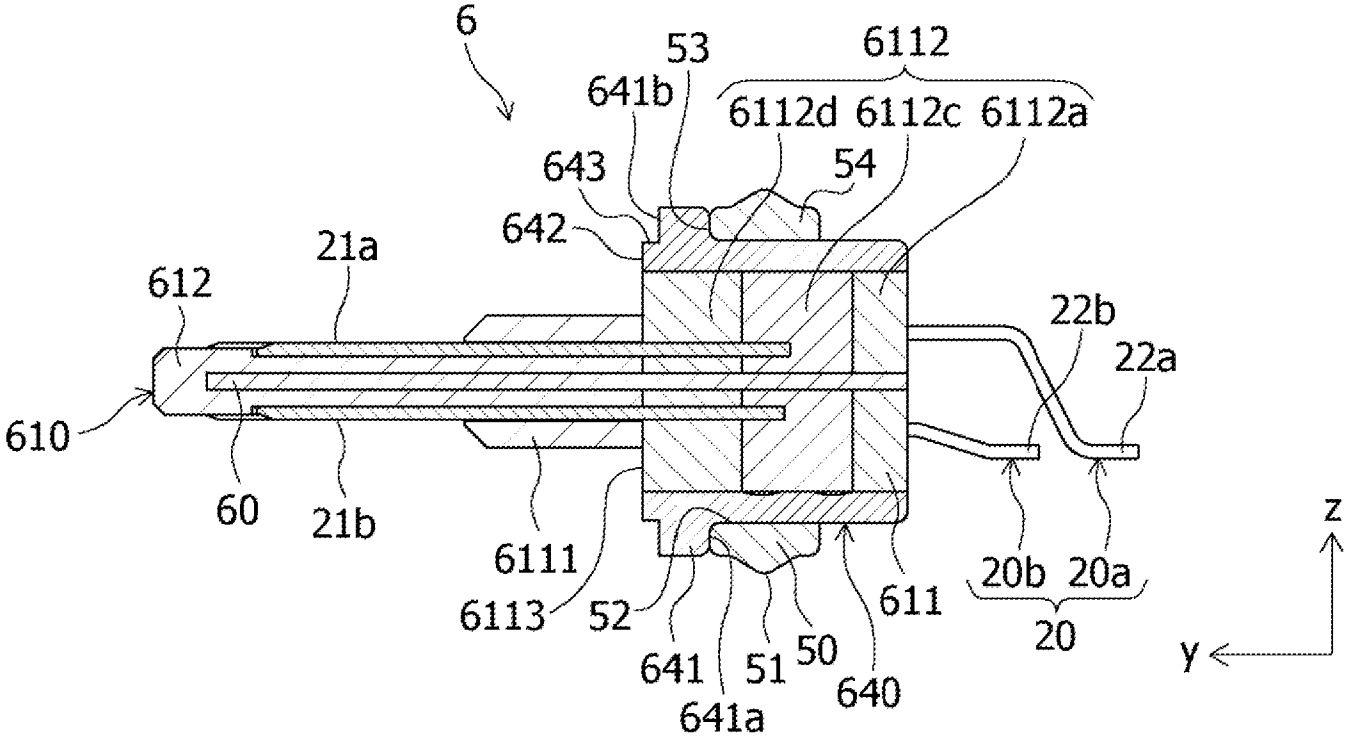
FIG. 18 is a cross-sectional view taken along E-E of FIG. 17.

Note that, in FIGS. 17 and 18, the same reference numerals as those in FIGS. 1 to 8 indicate the same components, and a description thereof is omitted.

The electrical connector 6 according to this embodiment includes contacts 20, a seal member 50, a shielding plate 60, a housing 610, and a shell member 640.

The housing 610, which is made of an insulating material, is a holding member for holding the contacts 20. The housing 610 contains a silane coupling agent in a portion that is in close contact with the contacts 20 along outer peripheral surfaces of the contacts 20.

The housing 610 has a main body portion 611 and a plate-like portion 612.

The main body portion 611 holds the contacts 20. The main body portion 611 is provided at the rear of the plate-like portion 612 so as to protrude laterally relative to the plate-like portion 612. The main body portion 611 includes a front portion 6111, and a rear portion 6112.

The front portion 6111 protrudes forward from a front end of the rear portion 6112.

The rear portion 6112 is provided at the rear of the front portion 6111 so as to protrude laterally relative to the plate-like portion 612 and the front portion 6111. The rear portion 6112 is constituted of a front end portion 6112*d* containing no silane coupling agent, a rear end portion 6112*a* that is provided at a rear end of the housing 610 and contains no silane coupling agent, and a watertight resin portion 6112*c* that is provided between the front end portion 6112*d* and the rear end portion 6112*a* and contains a silane coupling agent.

The watertight resin portion 6112*c* is in close contact with the shell member 640 along a circumferential direction of an inner peripheral surface of the shell member 640, as well as being in close contact with the contacts 20 along the outer peripheral surfaces of the contacts 20. The watertight resin portion 6112*c* is made of a resin of a different type from the resin of the plate-like portion 612, the front portion 6111, the rear end portion 6112*a*, and the front end portion 6112*d*. The resin of the watertight resin portion 6112*c* melts at a lower temperature than the resin of the plate-like portion 612, the front portion 6111, the rear end portion 6112*a*, and the front end portion 6112*d*.

The front end portion 6112*d* includes a contact portion 6113 that is in contact with a not-shown mating connector connected from its front to prevent a rearward movement of the mating connector.

Note that FIG. 18 shows clear boundaries between the front end portion 6112*d*, the rear end portion 6112*a*, and the watertight resin portion 6112*c*, for the sake of explanation, but the boundaries are unclear in fact, because the front end portion 6112*d* and the watertight resin portion 6112*c* are melted and bonded at their contact portions in a manufacturing process, and the rear end portion 6112*a* and the watertight resin portion 6112*c* are melted and bonded at their contact portions in the manufacturing process.

The plate-like portion 612, i.e., a front protruding portion, is in the shape of a plate that protrudes forward relative to the main body portion 611.

The shell member 640 is made of a conductive material or an insulating material, and is in the shape of a cylinder penetrating in the front and rear directions. The shell member 640 is held by the rear portion 6112, and is in close contact with the watertight resin portion 6112*c* along a circumferential direction of an inner peripheral surface. The shell member 640 is formed by processing a metal plate (drawing or the like), die casting, or metal injection molding.

The shell member 640 includes a rib 641, a contact portion 642, and a contact portion 643.

The rib 641, i.e., a lateral protruding portion, is provided on an outer periphery of the shell member 640 in a circumferential direction, and laterally protrudes from the outer periphery of the shell member 640. The rib 641 includes a contact surface 641*a*, with which the front end portion 53 of the seal member 50 is in contact, and a contact surface 641*b* that, when the electrical connector 6 is installed in an installation member, is in contact with the installation member (for example, the contact surface 204 shown in FIG. 9).

The contact portion 642 is in contact with a not-shown mating connector connected from its front to prevent a rearward movement of the mating connector.

The contact portion 643 is provided around the front end of the shell member 640 in an annular manner. When the electrical connector 6 is installed in the installation member, the contact portion 643 is in contact with the installation member (for example, the internal wall 205 shown in FIG. 9).

The seal member 50 is in a ring shape, and is provided on an outer periphery of the shell member 640 and also provided to the main body portion 611 via the shell member 640. As shown in FIG. 18, the seal member 50 includes a press contact portion 51 that protrudes laterally relative to the rib 641 of the shell member 640 and is in press contact with an installation member, an internal wall portion 52 that is in contact or press contact with an outer periphery of the shell member 640, the front end portion 53 that is in contact or press contact with the contact surface 641*a* of the rib 641 of the shell member 640, and a proximal end portion 54 as a secured portion that is secured to the outer periphery of the shell member 640. The internal wall portion 52 is secured to the outer periphery of the shell member 640 by bonding or the like using an adhesive, and the front end portion 53 is secured to the contact surface 641*a* by bonding or the like using an adhesive.

<Method for Installing Electrical Connector in Installation Member>

A method for installing the electrical connector 6 according to the sixth embodiment will be described below in detail. By way of example, a method for installing the electrical connector 6 in the casing 200 shown in FIG. 9 will be described.

To insert and install the electrical connector 6 into the installation hole 202 from its rear to its front, the plate-like portion 612 is first inserted into the installation hole 202 from its rear, and subsequently the main body portion 611 is inserted into the installation hole 202 from its rear. The shell member 640 is inserted into the installation hole 202 from its rear, and subsequently the plate-like portion 612 is inserted into the installation hole 201 from its rear. At this time, since the outer diameter of the contact portion 643 of the shell member 640 is approximately the same as or slightly smaller than the inner diameter D1 of the installation hole 201, the contact portion 643 is in contact with the internal wall 205.

Since the seal member 50 is in press contact with the internal wall 203 of the installation hole 202 at the press contact portion 51, the seal member 50 is elastically deformed inwardly. At this time, the proximal end portion 54, i.e., a securing portion of the seal member 50 relative to the shell member 640, does not protrude laterally relative to the rib 641. Therefore, for example, when the electrical connector 6 is shifted or the like in a direction orthogonal to front and back directions, in the middle of inserting the electrical connector 6 into the installation hole 201 and the installation hole 202, the proximal end portion 54 is prevented from getting snagged on the casing 200, and therefore the seal member 50 can be prevented from being damaged or displaced.

The electrical connector 6 can be prevented from being upsized, even if the thickness of the seal member 50 is increased. Accordingly, since the thickness of a compression portion of the seal member 50 can be increased without an increase in the inside diameter D2, a press contact capable area can be enlarged in an appropriate compressibility of the seal member 50 against the internal wall 203, and thereby the dimensions of the internal wall 203 are not required to be managed with high accuracy, thus allowing an increase in productivity.

Contact of the contact surface 641*b* of the rib 641 of the shell member 640 with the contact surface 204 of the casing 200 regulates a forward movement of the electrical connector 6, and the electrical connector 6 is thereby completed to be inserted into the casing 200.

As described above, the contact surface 641*b* of the rib 641 of the shell member 640 is in contact with the contact surface 204. Since this hinders a forward movement of the shell member 640 relative to the casing 200, the shell member 640 can be used as a positioning member of the electrical connector 6 relative to the casing 200.

When the casing 200 constituting a part of the fitting portion of the electrical connector 6 has a conductive property, it is possible to reduce noise from outside and thereby improve electrical performance of the electrical connector 6.

When the shell member 640, which is provided on the outer periphery of the rear portion 6112 so as to cover the rear portion 6112, has a conductive property, it is possible to reduce noise from outside and thereby improve electrical performance of the electrical connector 6.

Furthermore, when the casing 200 and the shell member 640 have conductive properties, since the contact portion 643 is connected to the casing 200, the casing 200 and the shell member 640 cover the outer periphery of the housing 610, so that it is possible to reduce noise from outside and thereby improve electrical performance of the electrical connector 6.

In a state of completing installation of the electrical connector 6 in the casing 200, the installation hole 201 of the casing 200 constitutes an insertion hole into which a mating connector is inserted from its front, and the internal wall 205 of the installation hole 201 and the contact portion 642 and the contact portion 6113 constitute a fitting portion for the mating connector. In the state of completing installation of the electrical connector 6 in the casing 200, the contact portion 643 is in contact with the internal wall 205, and the entire seal member 50 evenly receives a pressure force from the internal wall 203. Therefore, the plate-like portion 612 is disposed along the internal wall 205 at the center of the installation hole 201, thus allowing a reliable connection between the electrical connector 6 and the mating connector.

When the mating connector is inserted into the foregoing fitting portion of the electrical connector 6 from its front, a front end of the mating connector in an insertion direction is in contact with the contact portion 642 and the contact portion 6113. The mating connector is thereby hindered from moving rearward, and a connection between the mating connector and the electrical connector 6 is completed. Note that, in a state of completing a connection between the mating connector and the electrical connector 6, a mating contact of the mating connector is electrically connected to the contact 20 of the electrical connector 6.

As described above, according to this embodiment, the insulating housing 610 includes the plate-like portion 612 and the main body portion 611 that is provided at the rear of the plate-like portion 612 and protrudes laterally relative to the plate-like portion 612, and the main body portion 611 is provided with the elastically deformable seal member 50. This eliminates the need for providing a portion to hold the seal member 50 on a front end side of the housing 610, thus allowing downsizing and slimming of the electrical connector 6. Since the thickness of the seal member 50 is not reduced more than necessary, a press contact capable area can be enlarged in an appropriate compressibility of the seal member 50 relative to the casing 200, and thereby, when the electrical connector 6 is installed in the casing 200, the dimensions of the casing 200 are not required to be managed with high accuracy, thus allowing an increase in productivity.

According to this embodiment, since the seal member 50 is provided in the main body portion 611 through the shell member 640, the main body portion 611 can be protected. Furthermore, when the shell member 640 has a conductive property, the shell member 640 blocks noise from outside, thus allowing an improvement in electrical performance of the electrical connector 6.

According to this embodiment, the shell member 640 includes the rib 641 that protrudes laterally in front of the seal member 50. When the electrical connector 6 is installed in the casing 200, the rib 641 prevents the casing 200 from getting snagged on the proximal end portion 54 of the seal member 50, and therefore the seal member 50 can be prevented from being damaged or displaced relative to the housing 610.

According to this embodiment, since the seal member 50 includes the press contact portion 51 that protrudes laterally relative to the rib 641 and is in press contact with the installation member, the seal member 50 can be reliably in press contact with the installation member.

According to this embodiment, since the seal member 50 is in contact with the contact surface 641*a* of the rib 641, the seal member 50 can be easily positioned with respect to the shell member 640.

According to this embodiment, since the internal wall 52 of the seal member 50 is secured to the outer periphery of the shell member 640 by bonding or the like, and the front end portion 53 of the seal member 50 is secured to the contact surface 641*a* of the rib 641 by bonding or the like, the seal member 50 can be secured to the shell member 640 at an increased securing surface. Therefore, since the seal member 50 can be firmly secured to the shell member 640, the seal member 50 is prevented from dropping off.

According to this embodiment, the provision of the seal member 50 on the outer periphery of the shell member 640 eliminates the need for providing a casing to provide the seal member 50, thus allowing downsizing and slimming of the electrical connector 6.

According to this embodiment, in a case where the seal member 50, the casing 200, and the shell member 640 have conductive properties, when the electrical connector 6 is installed in the casing 200, the shell member 640, the seal member 50, and the casing 200 are electrically connected. Therefore, when the casing 200 is a metal casing or the like of the electronic device, the electrical connector 6 can contribute to an improvement in shielding performance of the electronic device or measures against static electricity thereof.

According to this embodiment, since the watertight resin portion 6112*c* containing a silane coupling agent is in close contact with the inner peripheral surface of the shell member 640 so as to seal a gap between the watertight resin portion 6112*c* and the shell member 640, the interior of the electronic device in which the electrical connector 6 is installed can be tightly sealed from a gap between the housing 610 and the shell member 640, and can be made watertight. In the electrical connector 6, since the watertight resin portion 6112*c* containing the silane coupling agent is in close contact with the outer peripheral surfaces of the contacts 20 so as to seal gaps each between the watertight resin portion 6112*c* and each contact 20, the interior of the electronic device in which the electrical connector 6 is installed can be tightly sealed from gaps each between the housing 610 and each contact 20 and can be made watertight. Furthermore, since the electrical connector 6 can acquire a watertight function only by providing the watertight resin portion 6112*c* between the contacts 20 and the shell member 640, the rear side of the electrical connector 6 can be reduced in size.

In this embodiment, the main body portion 611 of the housing 610 may have an arbitrary shape, as long as the main body portion 611 protrudes laterally relative to the plate-like portion 612 and is contained in the shell member 640.

Seventh Embodiment

The configuration of an electrical connector 7 according to a seventh embodiment of the present invention will be described below in detail with reference to FIG. 19.

Figure 19:
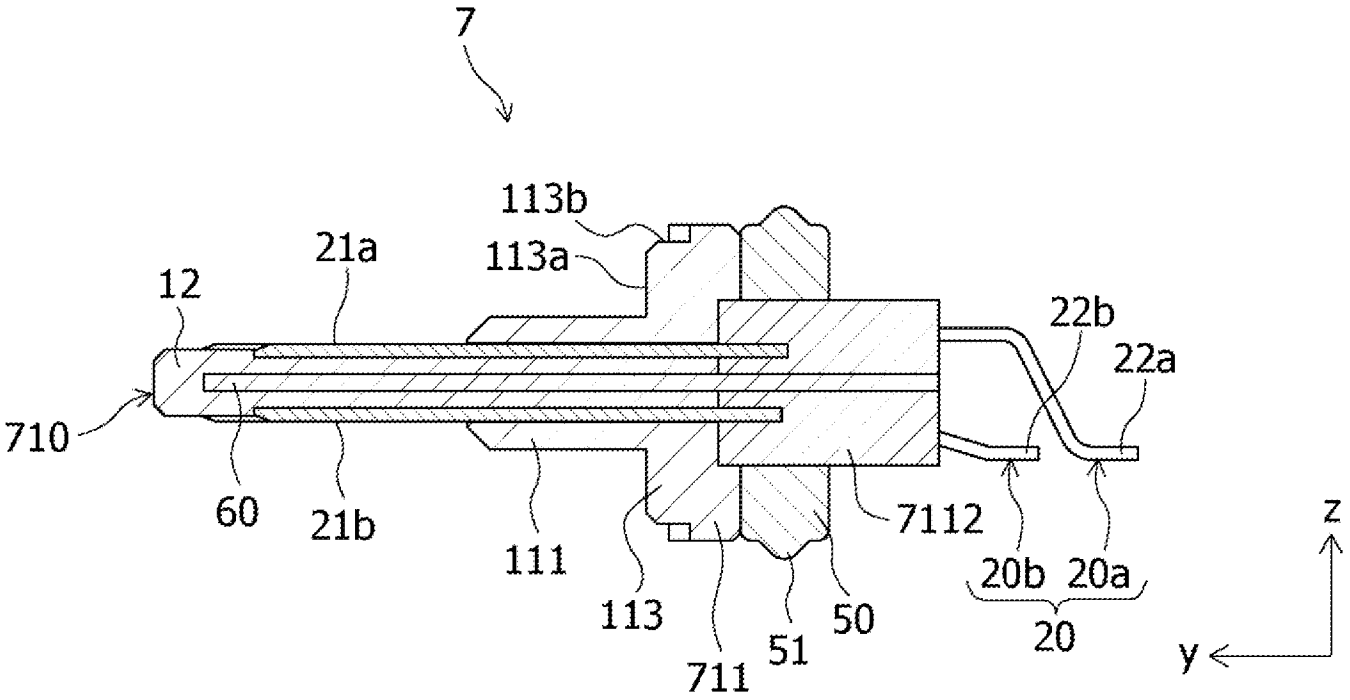
FIG. 19 is a cross-sectional view of an electrical connector according to a seventh embodiment of the present invention.

Note that, in FIG. 19, the same reference numerals as those in FIGS. 1 to 8 indicate the same components, and a description thereof will be omitted.

The electrical connector 7 according to this embodiment includes contacts 20, a seal member 50, a shielding plate 60, and a housing 710.

The housing 710, which is made of an insulating material, is a holding member for holding the contacts 20. The housing 710 includes a plate-like portion 12 and a main body portion 711.

The main body portion 711 holds the contacts 20. The main body portion 711 is provided at the rear of the plate-like portion 12 so as to protrude laterally relative to the plate-like portion 12. The main body portion 711 includes a front portion 111, a contact portion 113, and a rear portion 7112.

The rear portion 7112 protrudes rearward from a rear end of the contact portion 113.

The contact portion 113 is provided between the front portion 111 and the rear portion 7112 so as to protrude laterally relative to the front portion 111 and the rear portion 7112. A front end of the contact portion 113 is provided with a front end surface 113*a* that is in contact with a not-shown mating connector connected from its front to block a rearward movement of the mating connector, and a contact surface 113*b* that is in contact with an installation member when the electrical connector 7 is installed in the installation member. The contact surface 113*b* is orthogonal to the front end surface 113*a*. The front end surface 113*a* is provided in an annular manner around the front portion 111. The contact surface 113*b* is provided in an annular manner in the outer periphery of the contact portion 113.

The plate-like portion 12, i.e., a front protruding portion, is in the shape of a plate that protrudes forward relative to the main body portion 711.

The seal member 50 is in a ring shape, and is provided on an outer periphery of the rear portion 7112 of the housing 710. The seal member 50 includes a press contact portion 51 that protrudes laterally relative to the contact portion 113 and is in press contact with an installation member, an internal wall portion 52 that is in press contact with an outer periphery of the rear portion 7112, a front end portion 53 that is in press contact with the rear end of the contact portion 113, and a proximal end portion 54 as a secured portion that is secured to the rear portion 7112. The internal wall portion 52 is secured to the outer periphery of the rear portion 7112 by bonding or the like using an adhesive, and the front end portion 53 is secured to the rear end of the contact portion 113 by bonding or the like using an adhesive.

Note that the seal member 50 is not necessarily secured to the rear portion 7112 by bonding, but may be secured to the rear portion 7112 by press fitting from its rear. The seal member 50 can be secured to the rear portion 7112 by an arbitrary method. A part of the seal member 50, except for the press contact portion 51 of the seal member 50, may protrude laterally relative to the contact portion 113. Note that the other structure of the seal member 50, except for the above, is the same as that of the seal member 50 according to the first embodiment described above, so that a description thereof is omitted.

Although the electrical connector 7 has no shell member, when a casing in which the electrical connector 7 is installed has a conductive property, the casing covers the entire electrical connector 7 from its front end to its rear end, so that it is possible to reduce noise from outside and improve electrical performance of the electrical connector 7.

As described above, according to this embodiment, since the elastically deformable seal member 50 is provided in the rear portion 7112 of the main body portion 711, the installation member is prevented from getting snagged on the proximal end portion 54 of the seal member 50 provided on the housing 710, thus allowing downsizing and slimming of the electrical connector 7, as well as allowing an improvement in productivity.

According to this embodiment, no shell member is provided, thus allowing downsizing and slimming of the electrical connector 7.

In this embodiment, the main body portion of the housing is not limited to the shape of the main body portion 711 in FIG. 19, but may have an arbitrary shape, as long as the main body portion protrudes laterally relative to the plate-like portion 12.

The present invention is not limited to the foregoing embodiments in terms of the types, arrangement, numbers, or the like of the members. It will be understood that appropriate modifications may be made without departing from the gist of the invention. For example, the components may be replaced with ones having similar operations and effects as appropriate.

The embodiments of the present invention are suitably applied to electrical connectors having a watertight function.

REFERENCE SIGNS LIST

1 electrical connector
2 electrical connector
3 electrical connector
4 electrical connector
5 electrical connector
6 electrical connector
7 electrical connector
10 housing
11 main body portion
12 plate-like portion
20 contact
20*a* first contact
20*b* second contact
40 shell member
41 diameter enlarging portion
42 constriction portion
43 rear end portion
50 seal member
51 press contact portion
52 internal wall portion
53 front end portion
54 proximal end portion
60 shielding plate
111 front portion
112 rear portion
113 contact portion
140 shell member
200 casing
201 installation hole
202 installation hole
203 internal wall
204 contact surface
205 internal wall
310 housing
311 main body portion
312 plate-like portion
340 shell member
341 rib
410 housing
411 main body portion
412 plate-like portion
440 shell member
510 housing
511 main body portion
512 plate-like portion
540 shell member
610 housing
611 main body portion
612 plate-like portion
640 shell member
641 rib
710 housing
711 main body portion

The invention claimed is:

1. An electrical connector comprising:

a holding member including a front protruding portion and a main body portion provided at the rear of the front protruding portion so as to protrude laterally relative to the front protruding portion, the holding member having an insulation property;

a contact having a conductive property, the contact being held by the holding member, the contact including a connection portion exposed at the front protruding portion so as to be connected to a mating contact of a mating connector and a terminal portion protruding from the main body portion;

a seal member configured to be elastically deformable and be provided in the main body portion; and a shell member configured to cover an outer periphery of the main body portion and be cylindrical, wherein the seal member is provided to the main body portion via the shell member, and the shell member includes a lateral protruding portion configured to laterally protrude in front of the seal member.

2. The electrical connector according to claim 1, wherein the seal member includes a press contact portion configured to protrude laterally relative to the lateral protruding portion so as to be in press contact with an installation member.

3. The electrical connector according to claim 1, wherein the seal member is in contact with a rear end of the lateral protruding portion.

4. The electrical connector according to claim 1, wherein the lateral protruding portion is in contact with an installation member to hinder a forward movement of the shell member relative to the installation member.

5. The electrical connector according to claim 1, wherein the shell member and the seal member each have a conductive property.

* * * * *